US011825271B2

(12) United States Patent
Rottier

(10) Patent No.: US 11,825,271 B2
(45) Date of Patent: Nov. 21, 2023

(54) HEARING PERFORMANCE AND HABILITATION AND/OR REHABILITATION ENHANCEMENT USING NORMAL THINGS

(71) Applicant: Cochlear Limited, Macquarie University (AU)

(72) Inventor: Riaan Rottier, Macquarie University (AU)

(73) Assignee: Cochlear Limited, Macquarie University (AU)

( * ) Notice: Subject to any disclaimer, the term of this patent is extended or adjusted under 35 U.S.C. 154(b) by 122 days.

(21) Appl. No.: 17/269,019

(22) PCT Filed: Sep. 12, 2019

(86) PCT No.: PCT/IB2019/057714
§ 371 (c)(1),
(2) Date: Feb. 17, 2021

(87) PCT Pub. No.: WO2020/053814
PCT Pub. Date: Mar. 19, 2020

(65) Prior Publication Data

US 2021/0329390 A1 Oct. 21, 2021

Related U.S. Application Data

(60) Provisional application No. 62/730,676, filed on Sep. 13, 2018.

(51) Int. Cl.
*H04R 25/00* (2006.01)

(52) U.S. Cl.
CPC ..... *H04R 25/554* (2013.01); *H04R 25/305* (2013.01); *H04R 2225/39* (2013.01);
(Continued)

(58) Field of Classification Search
CPC ..... H04R 25/554; H04R 25/305; H04R 2225/39; H04R 2225/41; H04R 2225/43;
(Continued)

(56) References Cited

U.S. PATENT DOCUMENTS 8,571,241 B2 * 10/2013 Larsen ..... H04R 25/554 381/315
9,064,501 B2 6/2015 Yamada et al.
(Continued)

FOREIGN PATENT DOCUMENTS

| | | | |
|---|---|---|---|
| CN | 105308681 | A | 2/2016 |
| JP | 2001320800 | A | 11/2001 |
| WO | 2017157443 | A1 | 9/2017 |

OTHER PUBLICATIONS

International Search Report & Written Opinion for PCT/IB2019/057714, dated Dec. 20, 2019.
(Continued)

*Primary Examiner* — Brian Ensey
(74) *Attorney, Agent, or Firm* — Pilloff Passino & Cosenza LLP; Martin J. Cosenza

(57) ABSTRACT

A system, including a first microphone of a non-body carried device and a processor configured to receive input based on sound captured by the first microphone and analyze the received input to determine whether the sound captured by the first microphone is indicative of an attempted communication between humans, which humans are located in a structure where the microphone is located, upon a determination that the sound is indicative of an attempted communication between humans, evaluate the success of that communication.

22 Claims, 16 Drawing Sheets

(52) U.S. Cl.
CPC ..... *H04R 2225/41* (2013.01); *H04R 2225/43* (2013.01); *H04R 2400/01* (2013.01)

(58) Field of Classification Search
CPC .. H04R 2400/01; H04R 25/43; H04R 25/558; H04R 25/606; H04R 25/70; H04R 2225/55; H04R 2460/07; H04R 2460/13
See application file for complete search history.

(56) References Cited

U.S. PATENT DOCUMENTS

| | | | |
|---|---|---|---|
| 9,467,786 | B2 | 10/2016 | Lee et al. |
| 9,769,576 | B2 | 9/2017 | Marquis et al. |
| 10,238,333 | B2 | 3/2019 | Hwang et al. |
| 2002/0106094 | A1 | 8/2002 | Fujino |
| 2012/0215283 | A1 | 8/2012 | Chambers et al. |
| 2013/0177188 | A1 | 7/2013 | Apfel et al. |
| 2015/0380010 | A1 | 12/2015 | Srinivasan |
| 2017/0303053 | A1 | 10/2017 | Falch et al. |
| 2018/0124527 | A1 | 5/2018 | El-Hoiydi et al. |
| 2018/0125415 | A1 | 5/2018 | Reed et al. |

OTHER PUBLICATIONS

Office action and Search Report for Chinese Patent Application No. 201980048933.9, dated Aug. 18, 2021.

* cited by examiner 10
100
101
102
103
104
105
106
107
108
109
110
111
112
114
116
118
119
120
121
122
123
126
130
132
134
136
140
142
146
147
148

HEARING PERFORMANCE AND HABILITATION AND/OR REHABILITATION ENHANCEMENT USING NORMAL THINGS

CROSS-REFERENCE TO RELATED APPLICATIONS

This application claims priority to U.S. Provisional Application No. 62/730,676, entitled HEARING PERFORMANCE AND HABILITATION AND/OR REHABILITATION ENHANCEMENT USING NORMAL THINGS, filed on Sep. 13, 2018, naming Riaan ROTTIER of Macquarie University, Australia as an inventor, the entire contents of that application being incorporated herein by reference in its entirety.

BACKGROUND

Hearing loss, which may be due to many different causes, is generally of two types: conductive and sensorineural. Sensorineural hearing loss is due to the absence or destruction of the hair cells in the cochlea that transduce sound signals into nerve impulses. Various hearing prostheses are commercially available to provide individuals suffering from sensorineural hearing loss with the ability to perceive sound. One example of a hearing prosthesis is a cochlear implant. Conductive hearing loss occurs when the normal mechanical pathways that provide sound to hair cells in the cochlea are impeded, for example, by damage to the ossicular chain or the ear canal. Individuals suffering from conductive hearing loss may retain some form of residual hearing because the hair cells in the cochlea may remain undamaged.

Individuals suffering from hearing loss typically receive an acoustic hearing aid. Conventional hearing aids rely on principles of air conduction to transmit acoustic signals to the cochlea. In particular, a hearing aid typically uses an arrangement positioned in the recipient's ear canal or on the outer ear to amplify a sound received by the outer ear of the recipient. This amplified sound reaches the cochlea causing motion of the perilymph and stimulation of the auditory nerve. Cases of conductive hearing loss typically are treated by means of bone conduction hearing aids. In contrast to conventional hearing aids, these devices use a mechanical actuator that is coupled to the skull bone to apply the amplified sound. In contrast to hearing aids, which rely primarily on the principles of air conduction, certain types of hearing prostheses commonly referred to as cochlear implants convert a received sound into electrical stimulation. The electrical stimulation is applied to the cochlea, which results in the perception of the received sound. Many devices, such as medical devices that interface with a recipient, have structural and/or functional features where there is utilitarian value in adjusting such features for an individual recipient. The process by which a device that interfaces with or otherwise is used by the recipient is tailored or customized or otherwise adjusted for the specific needs or specific wants or specific characteristics of the recipient is commonly referred to as fitting. One type of medical device where there is utilitarian value in fitting such to an individual recipient is the above-noted cochlear implant.

SUMMARY

In an exemplary embodiment, there is a system, comprising a first microphone of a non-body carried device and a processor configured to receive input based on sound captured by the first microphone and analyze the received input to determine whether the sound captured by the first microphone is indicative of an attempted communication to a human, which human is located in a structure where the microphone is located and upon a determination that the sound is indicative of an attempted communication to a human, evaluate the success and/or probability of success of that communication and/or effortfulness of the human to understand the communication.

In an exemplary embodiment, there is a system, comprising a first microphone of a non-hearing prosthesis device and a processor configured to receive input based on data, such as, for example, voice, captured by the first microphone and analyze the received input in real time to identify a change to improve perception by a recipient of a hearing prosthesis.

In an exemplary embodiment, there is a method, comprising, during a first temporal period, capturing sound variously utilizing a plurality of different electronic devices having respective sound capture apparatuses that are stationary during the first temporal period while also separately capturing sound during the first temporal period utilizing a hearing prosthesis, evaluating data based on an output from at least one of the respective sound capture devices, and identifying an action to improve perception of sound by a recipient of the hearing prosthesis during the first temporal period based on the evaluated data.

A non-transitory computer readable medium having recorded thereon, a computer program for executing at least a portion of a method, the computer program including code for analyzing first data based on data captured by non-hearing prosthesis components, and code for identifying a hearing impacting influencing feature based on the analysis of the first data. Further, in an exemplary embodiment of this embodiment, there is also code for analyzing second data based on data indicative of a recipient of a hearing prosthesis's reaction to ambient sound exposed to the recipient contemporaneously to the data captured by the non-hearing prosthesis components, wherein the code for identifying a hearing impacting influencing feature based on the analysis of the first data includes code for identifying the hearing impacting influencing feature based on the analysis of the first data in combination with the analysis of the second data.

BRIEF DESCRIPTION OF THE DRAWINGS

Embodiments are described below with reference to the attached drawings, in which.

DETAILED DESCRIPTION

Embodiments will be described in terms of a cochlear implant, but it is to be noted that the teachings detailed herein can be applicable to other types of hearing prostheses, and other types of sensory prostheses as well, such as, for example, retinal implants, etc. In an exemplary embodiment of a cochlear implant and an exemplary embodiment of system that utilizes a cochlear implant with other components will first be described, where the implant and the system can be utilized to implement at least some of the teachings detailed herein. In an exemplary embodiment, any disclosure herein of a microphone or other sound capture device and a device that evokes a hearing percept corresponds to a disclosure of an alternate embodiment where the microphone or other sound capture device is replaced with an optical sensing device and the device that evokes a hearing percept is replaced with a device that evokes a sight percept (e.g., again, the components of a retinal implant, for example).

Figure 1:
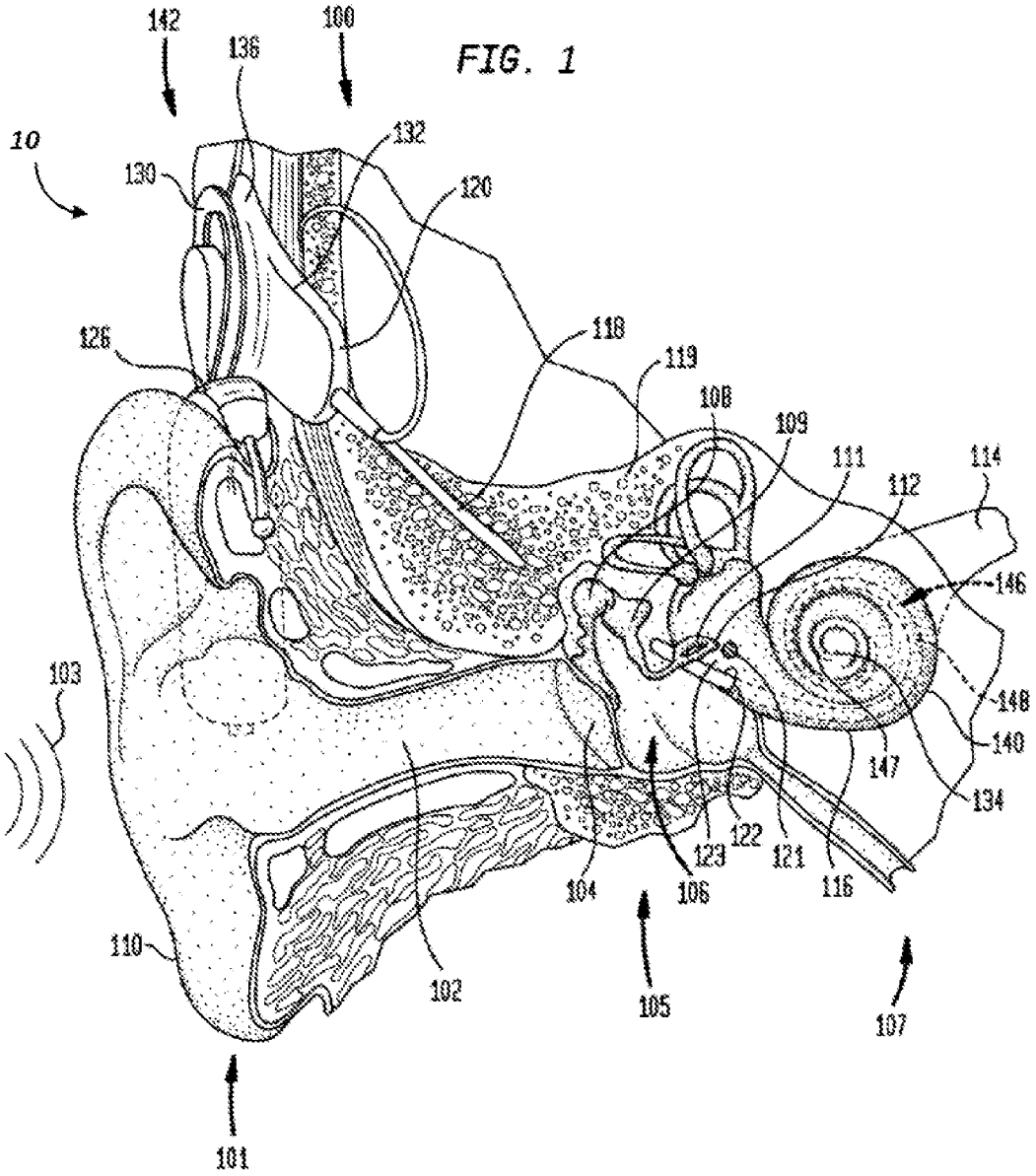
FIG. 1 is a perspective view of an exemplary hearing prosthesis in which at least some of the teachings detailed herein are applicable.

FIG. 1 is a perspective view of a cochlear implant, referred to as cochlear implant 100, implanted in a recipient, to which some embodiments detailed herein and/or variations thereof are applicable. The cochlear implant 100 is part of a system 10 that can include external components in some embodiments, as will be detailed below. Additionally, it is noted that the teachings detailed herein are also applicable to other types of hearing prostheses, such as by way of example only and not by way of limitation, bone conduction devices (percutaneous, active transcutaneous and/or passive transcutaneous), direct acoustic cochlear stimulators, middle ear implants, and conventional hearing aids, etc. Indeed, it is noted that the teachings detailed herein are also applicable to so-called multi-mode devices. In an exemplary embodiment, these multi-mode devices apply both electrical stimulation and acoustic stimulation to the recipient. In an exemplary embodiment, these multi-mode devices evoke a hearing percept via electrical hearing and bone conduction hearing. Accordingly, any disclosure herein with regard to one of these types of hearing prostheses corresponds to a disclosure of another of these types of hearing prostheses or any medical device for that matter, unless otherwise specified, or unless the disclosure thereof is incompatible with a given device based on the current state of technology. Thus, the teachings detailed herein are applicable, in at least some embodiments, to partially implantable and/or totally implantable medical devices that provide a wide range of therapeutic benefits to recipients, patients, or other users, including hearing implants having an implanted microphone, auditory brain stimulators, visual prostheses (e.g., bionic eyes), sensors, etc.

In view of the above, it is to be understood that at least some embodiments detailed herein and/or variations thereof are directed towards a body-worn sensory supplement medical device (e.g., the hearing prosthesis of FIG. 1, which supplements the hearing sense, even in instances when there are no natural hearing capabilities, for example, due to degeneration of previous natural hearing capability or to the lack of any natural hearing capability, for example, from birth). It is noted that at least some exemplary embodiments of some sensory supplement medical devices are directed towards devices such as conventional hearing aids, which supplement the hearing sense in instances where some natural hearing capabilities have been retained, and visual prostheses (both those that are applicable to recipients having some natural vision capabilities and to recipients having no natural vision capabilities). Accordingly, the teachings detailed herein are applicable to any type of sensory supplement medical device to which the teachings detailed herein are enabled for use therein in a utilitarian manner. In this regard, the phrase sensory supplement medical device refers to any device that functions to provide sensation to a recipient irrespective of whether the applicable natural sense is only partially impaired or completely impaired, or indeed never existed. Embodiments can include utilizing the teachings herein with a cochlear implant, a middle ear implant, a bone conduction device (percutaneous, passive transcutaneous and/or active transcutaneous), or a conventional hearing aid, etc.

The recipient has an outer ear 101, a middle ear 105, and an inner ear 107. Components of outer ear 101, middle ear 105, and inner ear 107 are described below, followed by a description of cochlear implant 100.

In a fully functional ear, outer ear 101 comprises an auricle 110 and an ear canal 102. An acoustic pressure or sound wave 103 is collected by auricle 110 and channeled into and through ear canal 102. Disposed across the distal end of ear channel 102 is a tympanic membrane 104 which vibrates in response to sound wave 103. This vibration is coupled to oval window or fenestra ovalis 112 through three bones of middle ear 105, collectively referred to as the ossicles 106 and comprising the malleus 108, the incus 109, and the stapes 111. Bones 108, 109, and 111 of middle ear 105 serve to filter and amplify sound wave 103, causing oval window 112 to articulate, or vibrate in response to vibration of tympanic membrane 104. This vibration sets up waves of fluid motion of the perilymph within cochlea 140. Such fluid motion, in turn, activates tiny hair cells (not shown) inside of cochlea 140. Activation of the hair cells causes appropriate nerve impulses to be generated and transferred through the spiral ganglion cells (not shown) and auditory nerve 114 to the brain (also not shown) where they are perceived as sound.

As shown, cochlear implant 100 comprises one or more components which are temporarily or permanently implanted in the recipient. Cochlear implant 100 is shown in FIG. 1 with an external device 142, that is part of system 10 (along with cochlear implant 100), which, as described below, is configured to provide power to implant, where the implanted cochlear implant includes a battery that is recharged by the power provided from the external device 142.

In the illustrative arrangement of FIG. 1, external device 142 can comprise a power source (not shown) disposed in a Behind-The-Ear (BTE) unit 126. External device 142 also includes components of a transcutaneous energy transfer link, referred to as an external energy transfer assembly. The transcutaneous energy transfer link is used to transfer power and/or data to cochlear implant 100. Various types of energy transfer, such as infrared (IR), electromagnetic, capacitive and inductive transfer, may be used to transfer the power and/or data from external device 142 to cochlear implant 100. In the illustrative embodiments of FIG. 1, the external energy transfer assembly comprises an external coil 130 that forms part of an inductive radio frequency (RF) communication link. External coil 130 is typically a wire antenna coil comprised of multiple turns of electrically insulated single-strand or multi-strand platinum or gold wire. External device 142 also includes a magnet (not shown) positioned within the turns of wire of external coil 130. It should be appreciated that the external device shown in FIG. 1 is merely illustrative, and other external devices may be used with embodiments.

Cochlear implant 100 comprises an internal energy transfer assembly 132 which can be positioned in a recess of the temporal bone adjacent auricle 110 of the recipient. As detailed below, internal energy transfer assembly 132 is a component of the transcutaneous energy transfer link and receives power and/or data from external device 142. In the illustrative embodiment, the energy transfer link comprises an inductive RF link, and internal energy transfer assembly 132 comprises a primary internal coil 136. Internal coil 136 is typically a wire antenna coil comprised of multiple turns of electrically insulated single-strand or multi-strand platinum or gold wire.

Cochlear implant 100 further comprises a main implantable component 120 and an elongate electrode assembly 118. In some embodiments, internal energy transfer assembly 132 and main implantable component 120 are hermetically sealed within a biocompatible housing. In some embodiments, main implantable component 120 includes an implantable microphone assembly (not shown) and a sound processing unit (not shown) to convert the sound signals received by the implantable microphone in internal energy transfer assembly 132 to data signals. That said, in some alternative embodiments, the implantable microphone assembly can be located in a separate implantable component (e.g., that has its own housing assembly, etc.) that is in signal communication with the main implantable component 120 (e.g., via leads or the like between the separate implantable component and the main implantable component 120). In at least some embodiments, the teachings detailed herein and/or variations thereof can be utilized with any type of implantable microphone arrangement.

Main implantable component 120 further includes a stimulator unit (also not shown) which generates electrical stimulation signals based on the data signals. The electrical stimulation signals are delivered to the recipient via elongate electrode assembly 118.

Elongate electrode assembly 118 has a proximal end connected to main implantable component 120, and a distal end implanted in cochlea 140. Electrode assembly 118 extends from main implantable component 120 to cochlea 140 through mastoid bone 119. In some embodiments electrode assembly 118 may be implanted at least in basal region 116, and sometimes further. For example, electrode assembly 118 may extend towards apical end of cochlea 140, referred to as cochlea apex 134. In certain circumstances, electrode assembly 118 may be inserted into cochlea 140 via a cochleostomy 122. In other circumstances, a cochleostomy may be formed through round window 121, oval window 112, the promontory 123 or through an apical turn 147 of cochlea 140.

Electrode assembly 118 comprises a longitudinally aligned and distally extending array 146 of electrodes 148, disposed along a length thereof. As noted, a stimulator unit generates stimulation signals which are applied by electrodes 148 to cochlea 140, thereby stimulating auditory nerve 114.

Figure 2A:
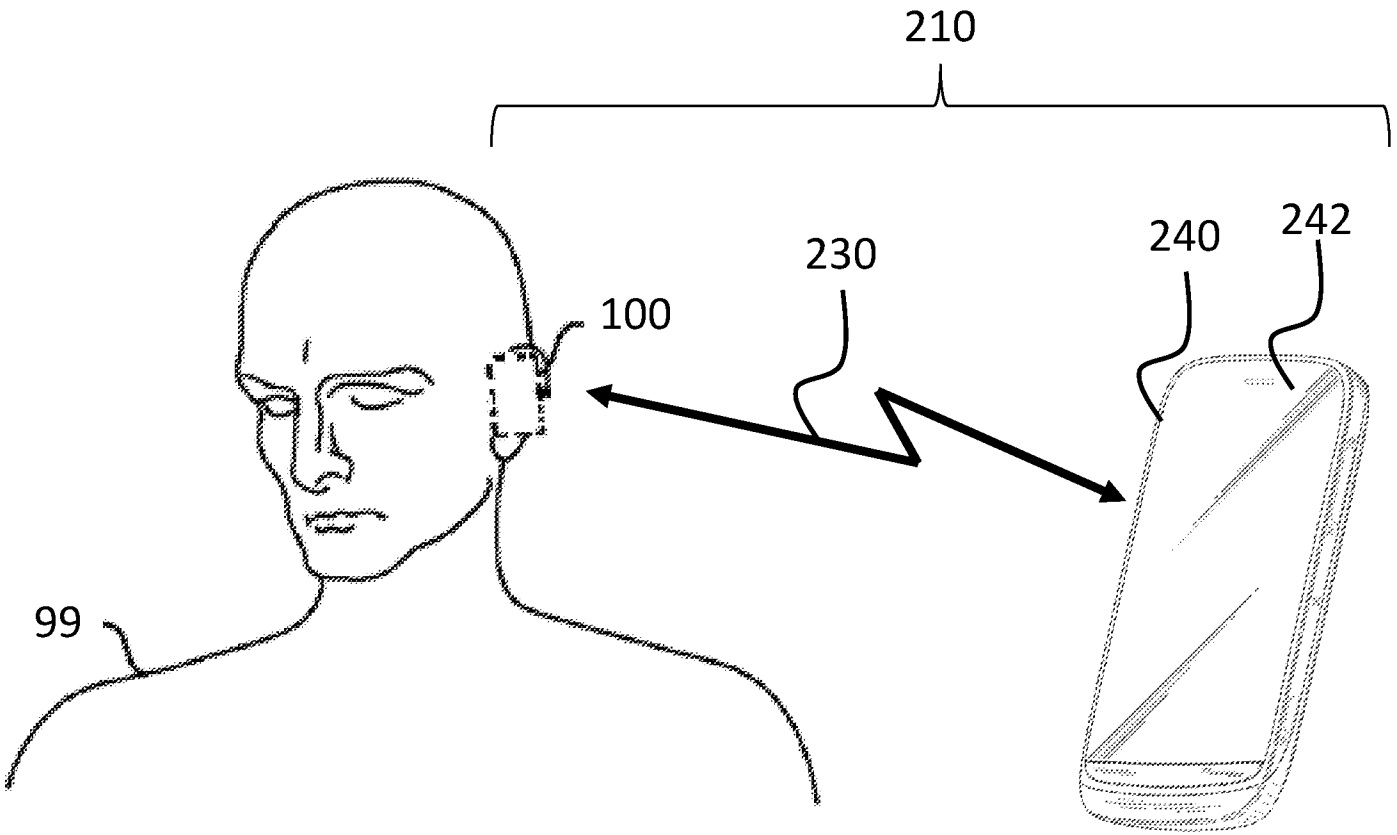
FIGS. 2A-3 presents exemplary systems.

FIG. 2A depicts an exemplary system 210 according to an exemplary embodiment, including hearing prosthesis 100, which, in an exemplary embodiment, corresponds to cochlear implant 100 detailed above, and a portable body carried device (e.g. a portable handheld device as seen in FIG. 2A, a watch, a pocket device, etc.) 240 in the form of a mobile computer having a display 242. The system includes a wireless link 230 between the portable handheld device 240 and the hearing prosthesis 100. In an embodiment, the prosthesis 100 is an implant implanted in recipient 99 (as represented functionally by the dashed lines of box 100 in FIG. 2A).

In an exemplary embodiment, the system 210 is configured such that the hearing prosthesis 100 and the portable handheld device 240 have a symbiotic relationship. In an exemplary embodiment, the symbiotic relationship is the ability to display data relating to, and, in at least some instances, the ability to control, one or more functionalities of the hearing prosthesis 100. In an exemplary embodiment, this can be achieved via the ability of the handheld device 240 to receive data from the hearing prosthesis 100 via the wireless link 230 (although in other exemplary embodiments, other types of links, such as by way of example, a wired link, can be utilized). As will also be detailed below, this can be achieved via communication with a geographically remote device in communication with the hearing prosthesis 100 and/or the portable handheld device 240 via link, such as by way of example only and not by way of limitation, an Internet connection or a cell phone connection. In some such exemplary embodiments, the system 210 can further include the geographically remote apparatus as well. Again, additional examples of this will be described in greater detail below.

As noted above, in an exemplary embodiment, the portable handheld device 240 comprises a mobile computer and a display 242. In an exemplary embodiment, the display 242 is a touchscreen display. In an exemplary embodiment, the portable handheld device 240 also has the functionality of a portable cellular telephone. In this regard, device 240 can be, by way of example only and not by way of limitation, a smart phone as that phrase is utilized generically. That is, in an exemplary embodiment, portable handheld device 240 comprises a smart phone, again as that term is utilized generically.

It is noted that in some other embodiments, the device 240 need not be a computer device, etc. It can be a lower tech recorder, or any device that can enable the teachings herein.

The phrase "mobile computer" entails a device configured to enable human-computer interaction, where the computer is expected to be transported away from a stationary location during normal use. Again, in an exemplary embodiment, the portable handheld device 240 is a smart phone as that term is generically utilized. However, in other embodiments, less sophisticated (or more sophisticated) mobile computing devices can be utilized to implement the teachings detailed herein and/or variations thereof. Any device, system, and/or method that can enable the teachings detailed herein and/or variations thereof to be practiced can be utilized in at least some embodiments. (As will be detailed below, in some instances, device 240 is not a mobile computer, but instead a remote device (remote from the hearing prosthesis 100. Some of these embodiments will be described below).)

In an exemplary embodiment, the portable handheld device 240 is configured to receive data from a hearing prosthesis and present an interface display on the display from among a plurality of different interface displays based on the received data. Exemplary embodiments will sometimes be described in terms of data received from the hearing prosthesis 100. However, it is noted that any disclosure that is also applicable to data sent to the hearing prostheses from the handheld device 240 is also encompassed by such disclosure, unless otherwise specified or otherwise incompatible with the pertinent technology (and vice versa).

It is noted that in some embodiments, the system 210 is configured such that cochlear implant 100 and the portable device 240 have a relationship. By way of example only and not by way of limitation, in an exemplary embodiment, the relationship is the ability of the device 240 to serve as a remote microphone for the prosthesis 100 via the wireless link 230. Thus, device 240 can be a remote mic. That said, in an alternate embodiment, the device 240 is a stand-alone recording/sound capture device.

It is noted that in at least some exemplary embodiments, the device 240 corresponds to an Apple Watch™ Series 1 or Series 2, as is available in the United States of America for commercial purchase as of Jun. 6, 2018. In an exemplary embodiment, the device 240 corresponds to a Samsung Galaxy Gear™ Gear 2, as is available in the United States of America for commercial purchase as of Jun. 6, 2018. The device is programmed and configured to communicate with the prosthesis and/or to function to enable the teachings detailed herein.

Figure 2B:
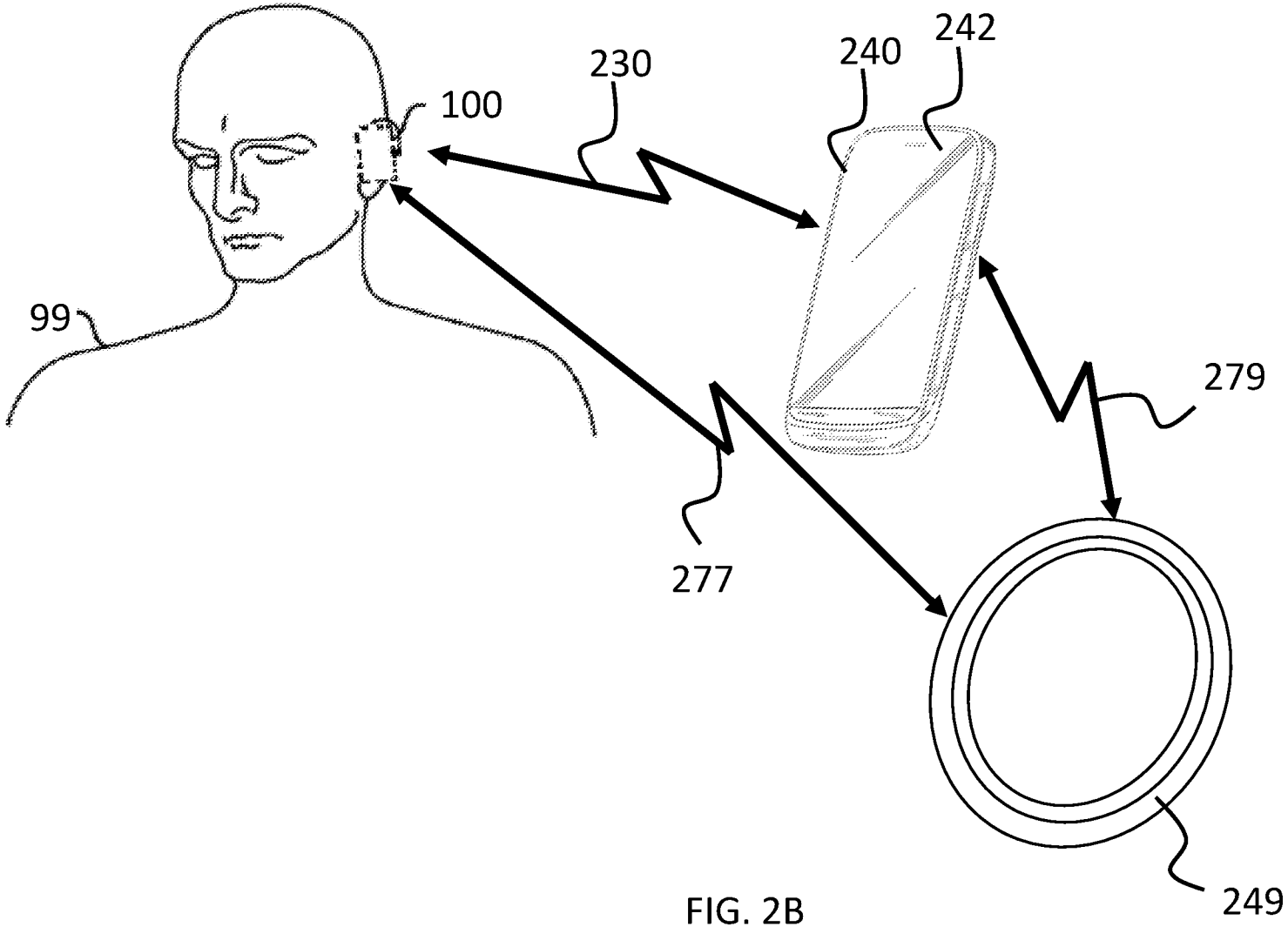

In an exemplary embodiment, a telecommunication infrastructure can be in communication with the hearing prosthesis 100 and/or the device 240. By way of example only and not by way of limitation, a telecoil 249 or some other communication system (Bluetooth, etc.) is used to communicate with the prosthesis and/or the remote device. FIG. 2B depicts an exemplary quasi-functional schematic depicting communication between an external communication system 249 (e.g., a telecoil), and the hearing prosthesis 100 and/or the handheld device 240 by way of links 277 and 279, respectively (note that FIG. 2B depicts two-way communication between the hearing prosthesis 100 and the external audio source 249, and between the handheld device and the external audio source 249—in alternate embodiments, the communication is only one way (e.g., from the external audio source 249 to the respective device)).

There can be utilitarian value with respect to providing or otherwise enabling recipients of hearing prostheses and/or their care givers and/or significant others and/or family members and/or otherwise friends, coworkers, etc., to understand or otherwise be informed of what they could do to improve hearing outcomes of the recipient and/or how to help the recipient progressing in habilitation and/or rehabilitation and/or simply to gauge how well such is occurring.

Moreover, there can be utilitarian value with respect to doing any of the above without the recipient engaging with a rehabilitation program and/or a performance test or questionnaires to determine their progress. Indeed, in an exemplary embodiment, there can be utilitarian value with respect to doing any of the above without interfering with the recipient's everyday activities and/or without tiring the recipient, as rehabilitation programs and/or performance testing or questionnaires can be tiring. There can also be utilitarian value with respect to doing any of the above by utilizing a passive system that captures voice of the recipient and/or of others who are speaking to the recipient, etc., where such capturing is executed utilizing a nondedicated hardware system and/or a device that is not necessarily attached to the recipient or otherwise carried by the recipient, at least beyond that associated with the hearing prosthesis of the recipient. There is also utilitarian value with respect to analyzing captured sounds in real time and/or providing feedback in real time/quasi-real time. In this regard, there is utilitarian value with respect to analyzing captured sounds and/or providing feedback in close temporal proximity to the time that the captured sounds were captured.

An exemplary embodiment utilizes existing microphones that might be found in a house or the like or in a workplace environment, to capture sound that is associated with a recipient. These microphones are utilized to capture sounds that might otherwise not be captured, or at least to capture sounds having metadata or the like associated therewith that can be utilized, where such metadata might not exist in the absence of the utilization of these microphones. In this regard, there are more and more high-performance microphone arrays in people's homes, for example Amazon Echo (7 microphones), Google Home (2 microphones), Apple HomePod (7 microphones), etc. These microphone arrays are connected to the cloud and allow third parties to write specific software that use the capabilities of the microphone array—for example Amazon Alexa 7-Mic Far Field Dev Kit. Moreover, microphones are ubiquitous in many devices, such as laptops, computers, smart phones, smart watches, phones in general (even a late $19^{th}$ century phone has a microphone that reacts to sound when the phone is not being used or otherwise "hung up,"—in some embodiments, general telephones can be utilized to capture sound even when the telephones are not being utilized for communication purposes), toys, play stations, televisions, cars, stereos, etc. at least some exemplary embodiments according to the teachings detailed herein utilize these home/office/transportation systems in combination with a processor apparatus, which can be part of a hearing prosthesis, and/or can be a separate component of a given system detailed herein, to provide passive monitoring for habilitation and/or rehabilitation and/or performance assessment and/or performance improvement or otherwise for performance change.

There can be utilitarian value with respect to some of the teachings detailed herein by utilizing existing hardware or other components that can enable the teachings detailed herein that are placed at fixed points in the room rather than requiring specialized hardware. In at least some exemplary embodiments, the microphone arrays on these systems are able to differentiate the location of sound originators (speakers, for example) in a given location and are able to obtain high quality audio from a plurality of speakers, such as by way of example only and not by way of limitation, through beamforming, noise cancellation, and/or echo cancellation. Furthermore, these systems, in some embodiments, can support real-time streaming and/or cloud-based analysis of the results which can provide increased processing over what is available on the processor or even on the iPhone/smartphone.

In an exemplary embodiment, there is a system that has one or more of the following, where the term "module" is used to refer to a compilation of hardware and/or software and/or firmware, whether distinct or in combination with other modules, that is configured to execute the detailed action (e.g., a processor that is programmed to do XYZ, that is part of an assembly or otherwise is in signal communication with or receives a signal from or based on a signal from a microphone, etc.), or otherwise is a feature of any device and/or system disclosed herein that has the functionality thereof:

- A module for interacting with the microphone(s) that are utilized in the system and obtaining the voice signal with associated direction and distance (if possible) in real time.
- A module for interacting with the hearing prosthesis in general, and, the logic/control components thereof (e.g., sound processor), and for obtaining own voice data and/or loudness information in real time.
- A module for processing the input from the hearing prosthesis and/or one or more microphone arrays in order to one or more of:

Determine the position and/or movement of each of the speakers and the position and/or movement of the recipient;

Identify the speaker and/or determine additional parameters to characterize each speaker—spectral information or similar to provide to the sound processor;

Determine when each speaker is speaking; or

Classify the utterances based on language specific heuristics, such as, for example, question, statement, clarification, response, etc.

A module for extracting performance/outcome measures from the speech data:

Speaker specific turn taking;

Recipient attention switching, such as, for example, head turning;

Classifying recipient directed speech vs. overheard speech;

Identifying stationary sources, such as, for example, television, radio and/or human sources;

Identifying clarification cues/inappropriate utterances from the recipient, such as, for example, responding to question.

A module for executing/monitoring rehabilitation exercises from the speech data:

Comparing interactions to expected interactions;

Using speech recognition to provide natural interactions, such as, for example, starting an audiobook, scripted conversation.

A reporting module for providing feedback to the recipient/caregiver, etc.

An embodiment includes a system that can execute any one or more of the functionalities listed above, and/or a method including any one or more of actions that accomplish a functionality listed above. In an exemplary embodiment, as will be described in greater detail below, processor apparatus 3401 has one or more or all of the above noted modules, and otherwise is configured to have the functionality of some and/or all of the above noted functionalities.

Figure 2C:
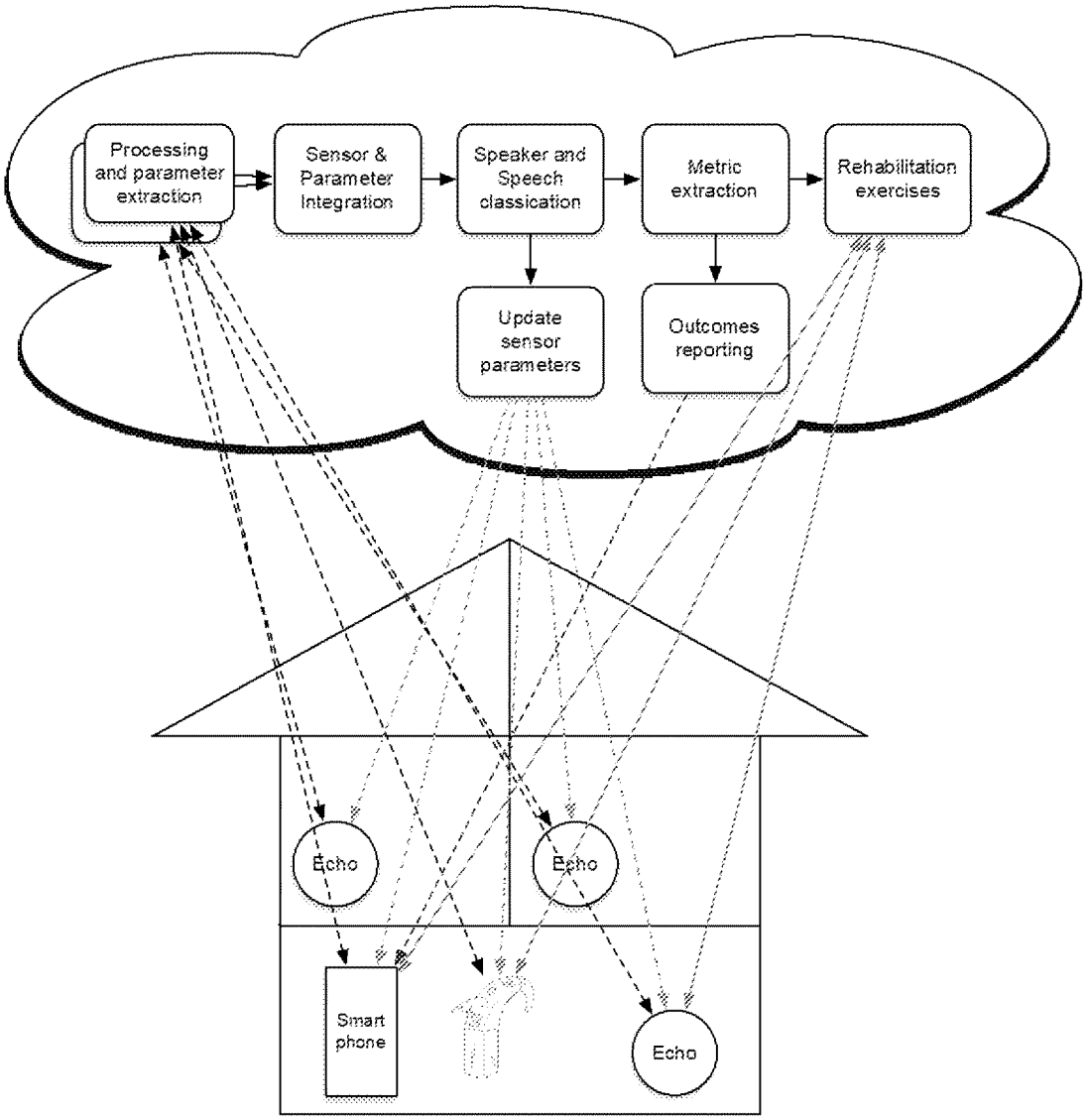

FIG. 2C presents a quasi-conceptual high level functional schematic that represents a conceptual exemplary embodiment.

Some additional details of some of the specifics will now be described of some exemplary embodiments.

Figure 3:
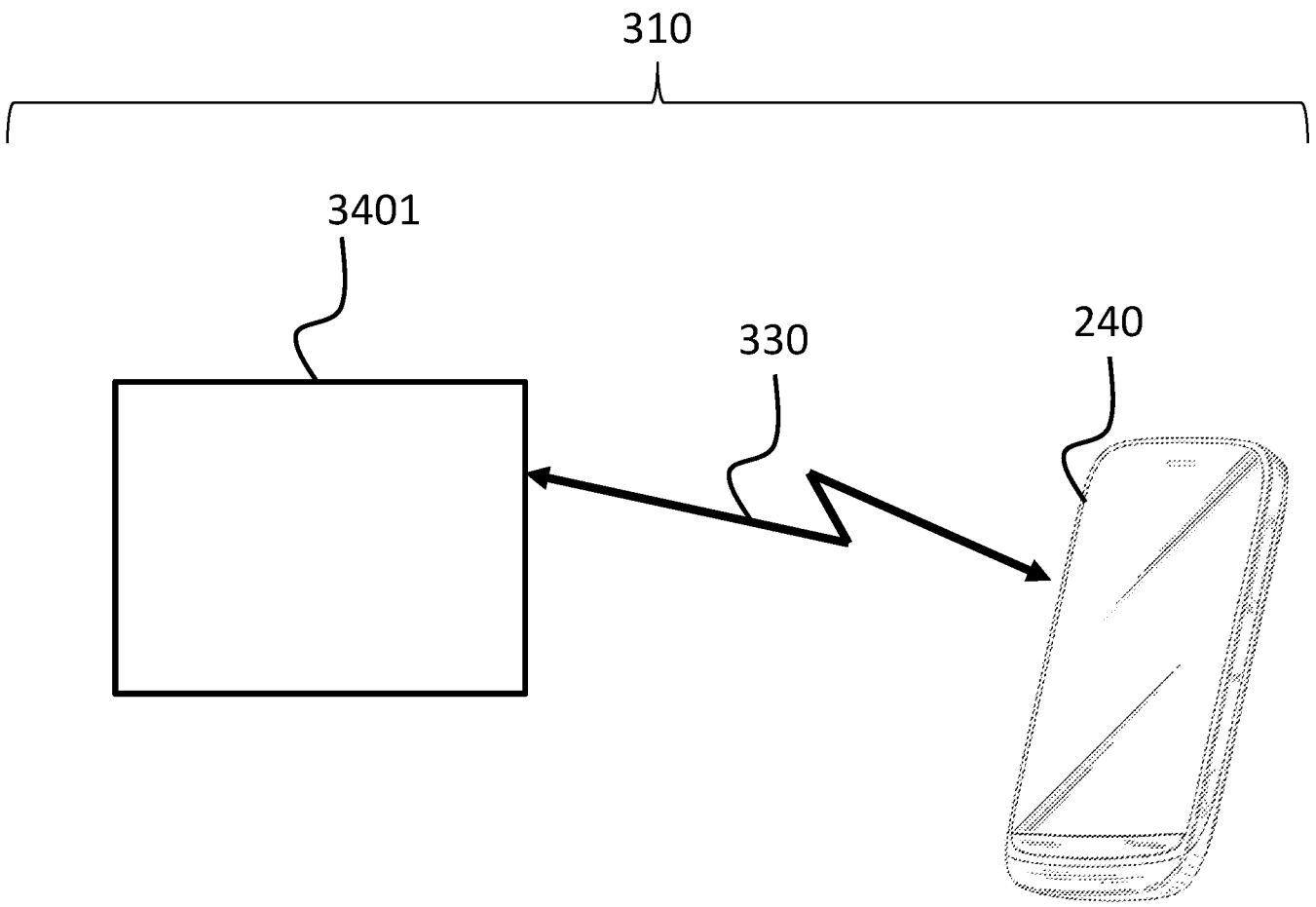

FIG. 3 depicts an exemplary embodiment of system 310, which system includes the aforementioned smart phone, which is in signal communication via wireless link 330 with a central processor apparatus 3401, the details of which will be described in greater detail below. In this exemplary embodiment, the smart phone 240, which can be also be a generic cellular phone in some other embodiments, is configured to capture sound utilizing the microphone thereof, and provide the sound that is captured via link 330 to the processor apparatus 3401. In an exemplary embodiment, link 330 is utilized to stream the captured audio signal captured by the microphone of the phone 240 utilizing an RF transmitter, and the processor apparatus 3401 includes an RF receiver that receives the transmitted RF signal. That said, in an exemplary embodiment, the phone 240 utilizes an onboard processor or the like to evaluate the signal, and provides a signal based on the captured sound that is indicative of the evaluation to the processor apparatus 3401. Some additional features of this will be described in greater detail below.

Figure 4A:
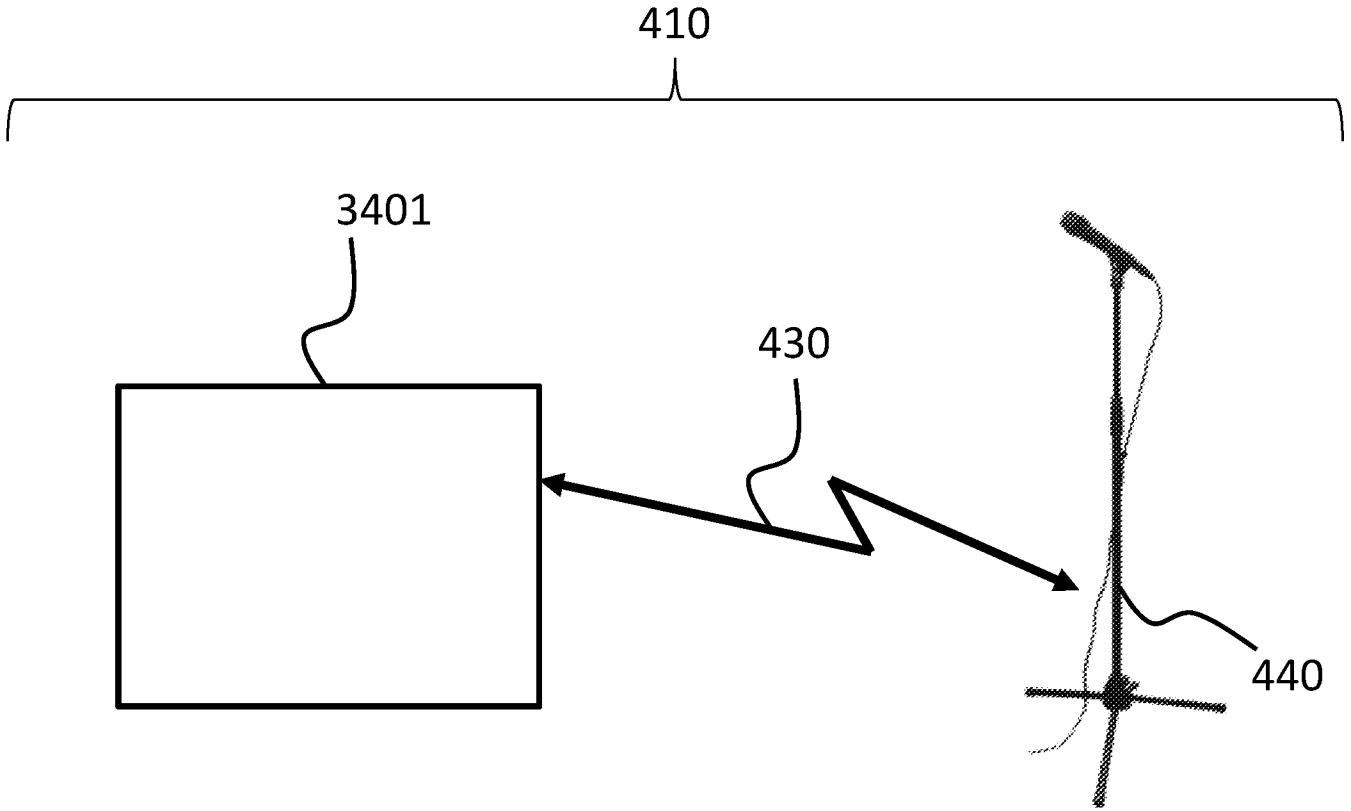
FIGS. 4A-4C present additional exemplary systems.
Figure 4B:
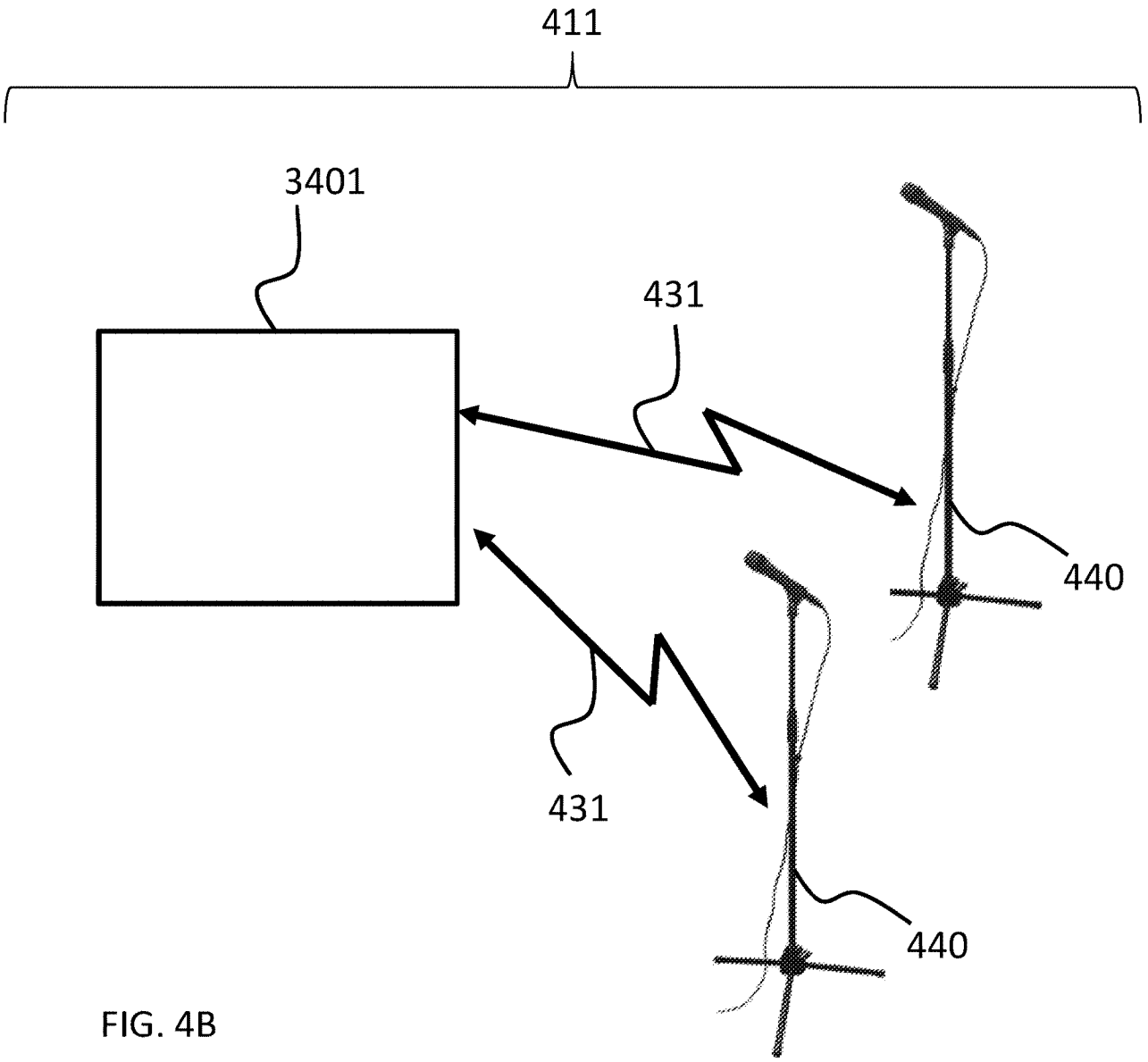

FIG. 4A depicts an alternate embodiment of a system 410 where a microphone 440 is utilized to capture sound. In an exemplary embodiment, microphone 440 operates in accordance with the microphone detailed above with respect to FIG. 3. That said, in an exemplary embodiment, microphone 440 can be that of a smart microphone, which includes a processor or the like in the assembly thereof, that can evaluate the captured sound at the location and provide a signal via the wireless link 430 to the processor apparatus 3401 which includes data that is based on the captured sound captured by microphone 440 in accordance with the alternate embodiment detailed above with respect to FIG. 3. FIG. 4B depicts an alternate embodiment of a system 411 that includes a plurality of microphones 440 that are in signal communication via the respective wireless links 431. Again, the plurality of microphones can correspond to a plurality of smart phones that are respective microphones, with plurality of microphones can correspond to microphones that are part of a household device, such as the aforementioned Amazon Echo or an Alexa device, or a computer or any other microphone that is part of a household device that can have utilitarian value or otherwise enable the teachings detailed herein. Further, it is noted that one or more of the microphones 440 can be microphones that are presented or otherwise positioned within a given structure (house, building, etc.) for the purposes of implementing the teachings detailed herein, and no other purpose. In this regard, an exemplary embodiment includes a package of microphone-transmitter assemblies that are configured to be figuratively thrown around a house at various locations, which assemblies have their own power sources and known transmitters that can communicate with each other (relay purposes) and/or with the central processor apparatus 3401, and/or with the hearing prosthesis as will be described below. Still, in an exemplary embodiment, microphones that are parts of consumer electronics devices are utilized, where the signals from the microphone can be obtained via the Internet of things of the like or any other arrangement that can enable the teachings detailed herein.

Figure 4C:
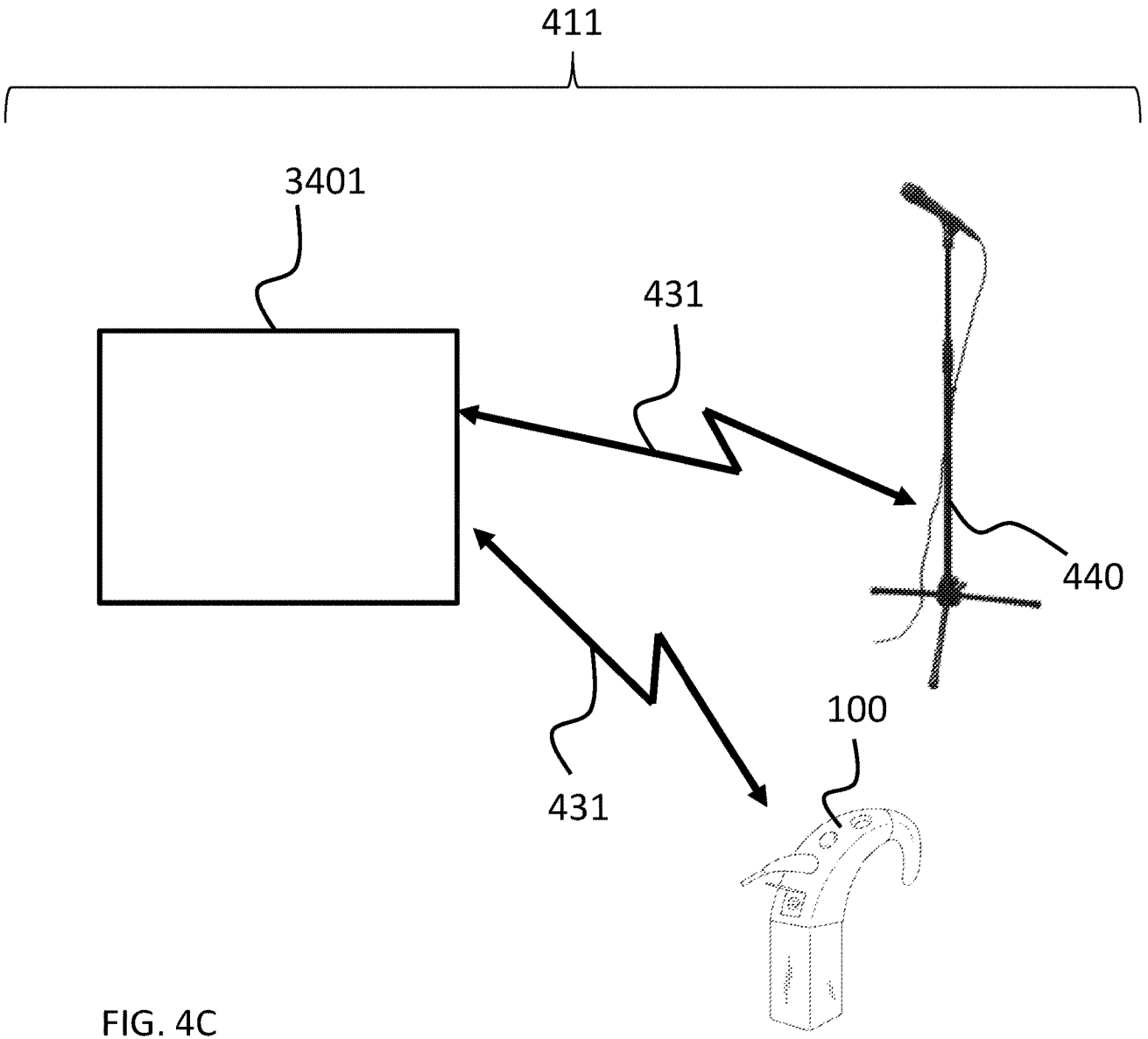

To be clear, it is noted that in at least some exemplary embodiments, the central processor apparatus 3401 can be the hearing prostheses 100. That said, in an alternate embodiment, it is a separate component relative to the hearing prostheses 100. FIG. 4C presents an exemplary embodiment where central processor apparatus 3401 is in signal communication with the prostheses 100. The central processor apparatus can be a smart phone of the recipient or a caregiver, and/or can be a personal computer or the like that is located in the house and/or can be a mainframe computer where the inputs based on data collected or otherwise obtained by the microphones is provided via a link, such as via the Internet, or the like, to a remote processor.

To further be clear, it is noted that any reference to a microphone herein can correspond to a microphone of the hearing prosthesis, a microphone of a personal handheld or body carried device, such as a cell phone or a smart phone, and/or a microphone of a commercial electronics product, and/or a microphone of a component that is dedicated for implementing the teachings detailed herein, unless otherwise noted.

In view of the above, it is to be understood that in an exemplary embodiment, there is a system, comprising a central processor apparatus configured to receive input from a plurality of sound capture devices, such as, for example, the smartphones 240 and/or the microphones 440 detailed above and/or the microphone(s) of one or more hearing prostheses, and/or from microphones or other sound capture devices of a hearing prosthesis and/or someone else's hearing prosthesis (in an exemplary embalmment, one or more of the sound capture devices are respective sound capture devices of hearing prostheses of people in the area, where the hearing prostheses are in signal communication with the central processor (directly or indirectly, such as, with respect to the latter, through a smart phone, or a cell phone, etc.) such an embodiment can also enable a dynamic system where the microphones move around from location to location, which can also be the case with, for example, the smart phones). The input can be the raw signal/modified signal (e.g., amplified and/or some features taken out/compression techniques can be applied thereto) from the microphones of the sound capture devices. The input can be based on the raw signal/modified signal, etc. In this regard, the phrase "data based on data from a microphone" can correspond to the raw output signal of the microphone, a signal that is a modified version of the raw output signal of the microphone, a signal that is an interpretation of the raw output, etc.

Thus, in an exemplary embodiment, there is a system that includes microphones that are configured to output respective signals indicative of respective captured sounds. The system is further configured to provide the respective signals and/or modified signals based on the respective signals to the central processor apparatus as input from the plurality of sound capture devices. Conversely, in some embodiments, the input can be a signal that is based on the sound captured by the microphones, but the signal is a data signal that results from the processing or otherwise the evaluations of the microphones, which data signal is provided to the central processor apparatus 3401. In this exemplary embodiment, the central processor apparatus is configured to collectively evaluate the input from the plurality of sound capture devices.

In an exemplary embodiment, the processor apparatus includes a processor, which processor of the processor apparatus can be a standard microprocessor supported by software or firmware or the like that is programmed to evaluate signals or other data received from or otherwise based on the sound capture device(s). By way of example only and not by way of limitation, in an exemplary embodiment, the microprocessor can have access to lookup tables or the like having data associated with spectral analysis of a given sound signal, by way of example, and can compare features of the input signal and compare those features to features in the lookup table, and, via related data in the lookup table associated with those features, make a determination about the input signal, and thus make a determination related to the sound and/or classifying the sound. In an exemplary embodiment, the processor is a processor of a sound analyzer. The sound analyzer can be FFT based or based on another principle of operation. The sound analyzer can be a standard sound analyzer available on smart phones or the like. Sound analyzer can be a standard audio analyzer. The processor can be part of a sound wave analyzer. Moreover, it is specifically noted that while the embodiment of the figures above present the processor apparatus 3401, and thus the processor thereof, as a device that is remote from the hearing prosthesis and/or the smart phones, and/or the microphones and the components having the microphones, etc., the processor can instead be part of one of the devices of the hearing prosthesis or the portable electronics device (e.g., smart phone, or any other device that can have utilitarian value with respect to implementing the teachings detailed herein) or the stationary electronic devices, etc. Still, consistent with the teachings above, it is noted that in some exemplary embodiments, the processor can be remote from the prosthesis and the smart phones or other portable consumer electronic devices.

By way of example only and not by way of limitation, in an exemplary embodiment, any one or more of the devices of systems detailed herein can be in signal communication via Bluetooth technology or other RF signal communication systems with each other and/or with a remote server that is linked, via, for example, the Internet or the like, to a remote processor. Indeed, in at least some exemplary embodiments, the processor apparatus 3401 is a device that is entirely remote from the other components of the system. That said, in an exemplary embodiment, the processor apparatus 3401 is a device that has components that are spatially located at different locations in a global manner, which components can be in signal communication with each other via the Internet or the like. In an exemplary embodiment, the signals received from the sound capture devices can be provided via the Internet to this remote processor, whereupon the signal is analyzed, and then, via the Internet, the signal indicative of an instruction related to data related to a recipient of the hearing prostheses can be provided to the device at issue, such that the device can output such. Note also that in an exemplary embodiment, the information received by the processor can simply be the results of the analysis, whereupon the processor can analyze the results of the analysis, and identify information that will then be outputted as will be described in greater detail below. It is noted that the term "processor" as utilized herein, can correspond to a plurality of processors linked together, as well as one single processor, and this is the case with respect to the phrase "central processor" as well.

In an exemplary embodiment, the system includes a sound analyzer in general, and, in some embodiments, a speech analyzer in particular, such as by way of example only and not by way of limitation, one that is configured to perform spectrographic measurements and/or spectral analysis measurements and/or duration measurements and/or fundamental frequency measurements. By way of example only and not by way of limitation, such can correspond to a processor of a computer that is configured to execute the SIL Language Technology Speech Analyzer™ program. In this regard, the program can be loaded onto memory of the system, and the processor can be configured to access the program to analyzer otherwise evaluate the speech. In an alternate embodiment, the speech analyzer can be that available from Rose Medical, which programming can be loaded one to the memory of the system. Moreover, in an exemplary embodiment, any one or more the method actions detailed herein and/or the functionalities of the devices and/or systems detailed herein can be implemented utilizing a machine learning system, such as by way of example only and not by way of limitation, a neural network and/or a deep neural network, etc. In this regard, in an exemplary embodiment, the various data that is utilized to achieve the utilitarian values presented herein is analyzed or otherwise manipulated or otherwise studied or otherwise executed by a neural network such as a deep neural network or any other product of machine learning. In some embodiments, the artificial intelligence system or otherwise product of machine learning is implemented in the hearing prostheses, while in other embodiments, it can be implemented in any of the other devices disclosed herein, such as a smart phone or a personal computer or a remote computer, etc.

In an exemplary embodiment, the central processing assembly can include an audio analyzer, which can analyze one or more of the following parameters: harmonic, noise, gain, level, intermodulation distortion, frequency response, relative phase of signals, etc. It is noted that the above-noted sound analyzers and/or speech analyzers can also analyze one or more of the aforementioned parameters. In some embodiments, the audio analyzer is configured to develop time domain information, identifying instantaneously amplitude as a function of time. In some embodiments, the audio analyzer is configured to measure intermodulation distortion and/or phase. In an exemplary embodiment, the audio analyzer is configured to measure signal-to-noise ratio and/or total harmonic distortion plus noise.

To be clear, in some exemplary embodiments, the central processor apparatus can include a processor that is configured to access software, firmware and/or hardware that is "programmed" or otherwise configured to execute one or more of the aforementioned analyses. By way of example only and not by way of limitation, the central processor apparatus can include hardware in this form of circuits that are configured to enable the analysis detailed above and/or below, the output of such circuitry being received by the processor so that the processor can utilize that output to execute the teachings detailed herein. In some embodiments, the processor apparatus utilizes analog circuits and/or digital signal processing and/or FFT. In an exemplary embodiment, the analyzer engine is configured to provide high precision implementations of AC/DC voltmeter values, (Peak and RMS), the analyzer engine includes high-pass and/or low-pass and/or weighting filters, the analyzer engine can include bandpass and/or Notch filters and/or frequency counters, all of which are arranged to perform an analysis on the incoming signal so as to evaluate that signal and identify certain characteristics thereof, which characteristics are correlated to predetermined scenarios or otherwise predetermined instructions and/or predetermined indications as will be described in greater detail below. It is also noted that in systems that are digitally based, the central processor apparatus is configured to implement signal analysis utilizing FFT based calculations, and in this regard, the processor is configured to execute FFT based calculations.

In an exemplary embodiment, the central processor is configured to utilize one or more or all of the aforementioned features to analyze the input from the microphones or otherwise analyze the input based on output of the microphones to implement the analyses or otherwise determinations detailed herein according to at least some exemplary embodiments.

In an exemplary embodiment, the central processor apparatus is a fixture of a given building (environmental structure). Alternatively, and/or in addition to this, the central processor apparatus is a standalone portable device that is located in a case or the like that can be brought to a given location. In an exemplary embodiment, the central processor apparatus can be a personal computer, such as a laptop computer, that includes USB port inputs and/or outputs and/or RF receivers and/or transmitters and is programmed as such (e.g., the computer can have Bluetooth capabilities and/or mobile cellular phone capabilities, etc.). Alternatively, or in addition to this, the central processor apparatus is a general electronics device that has a quasi-sole purpose to function according to the teachings herein. In an exemplary embodiment, the central processor apparatus is configured to receive input and/or provide output utilizing the aforementioned features or any other features.

Figure 5:
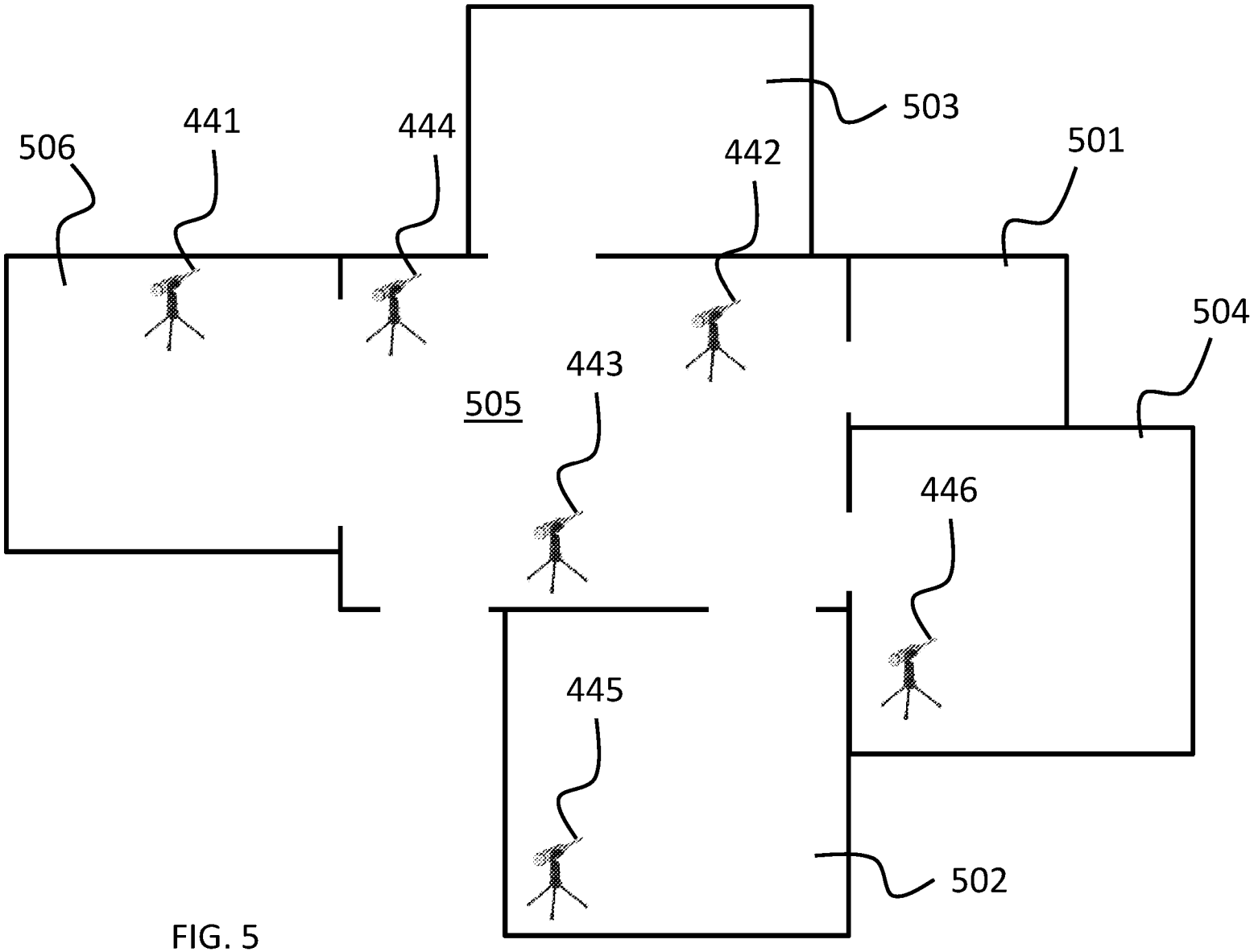
FIG. 5 presents an exemplary arrangement of microphones in a house.

Consistent with the teachings above that there be a plurality of microphones "prepositioned" in a building (home, office, classroom, school, etc.), in an exemplary embodiment, FIG. 5 depicts an exemplary structural environment corresponding to a house that includes bedrooms 502, 503, and 504, laundry room 501/utility room 501, living room 505, dining room 506, which represents area(s) in which a human speaker or someone or something that generates sound will be located. In this exemplary embodiment, there are a plurality of microphones present in the environment: a first microphone 441, second microphone 442, a third microphone 443, a fourth microphone 444, a fifth microphone 445, and a sixth microphone 446. In some embodiments, fewer or more microphones can be utilized. In this exemplary embodiment, the microphones are located in a known manner, which coordinates are provided to the central processor apparatus. In an exemplary embodiment, the microphones 44X (which refers to microphones 441-446) include global positioning system components and/or include components that communicate with a cellular system or the like that enable auto positions of these microphones to be determined via the central processor apparatus. In an exemplary embodiment, the system is configured to triangulate or otherwise ascertain relative locations of the various microphones to one another and/or relative to a another component or another actor in the system (e.g., the prosthesis or the recipient, etc.). In an exemplary embodiment, the microphones have markers, such as infrared indicators and/or RFID indicators and/or RFID transponders, that are configured to provide an output to another device, such as the central processor apparatus, and/or to each other, that can determine spatial locations of the microphones into one, two and/or three dimensions based on the output, which locations can be relative to the various microphones and/or relative to another component, such as the central processing assembly, or to another component not associated with the system, such as relative to the center of the house, a room where the recipient spends considerable time (e.g., recipient bedroom 502). Still further, in some embodiments, the devices of the microphones can be passive devices, such as reflectors or the like, that simply reflect a laser beam back to an interrogation device, based on the reflection, the device can determine the spatial locations of the microphones relative to each other and/or relative to another point.

In an exemplary embodiment, a person can move around carrying his or her cell phone/smartphone, and place the phone next to a given microphone, and activate a feature of the phone that will correlate the location of the microphone to a fixed location. By way of example only and not by way of limitation, applications such as smart phone applications that enable the location of a property line of a piece of land to be located relative to positioning of the smart phone can be utilized to determine the position of the microphones, etc. In an exemplary embodiment, a light capture device, such as a video camera or the like that is in signal communication with a processor, can be utilized to obtain images of a room and in an automated and/or a manual fashion (e.g., a person clicks at the location on a computer screen of the microphone), identifies the microphones in the images, and thus extracts the locational data therefrom. Any device, system, and/or method that can enable the position location of the microphones to be determined to enable the teachings detailed herein can be utilized in at least some exemplary embodiments. In an exemplary embodiment, image recognition systems are utilized to determine or otherwise map microphone placement.

That said, in some embodiments, positioning information is not needed or otherwise is not utilized to implement some of the teachings.

In an exemplary embodiment, microphones 44X are in wired and/or wireless communication with the central processor apparatus.

It is noted that while the embodiments detailed herein have focused on about 6 or fewer sound capture devices/microphones, in an exemplary embodiment, the teachings detailed herein can be executed utilizing 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40, or 50 or 60 or 70 or 80 or 90 or 100 microphones or more, or any value or range of values therebetween in increments of 1), which microphones can be utilized to sample or otherwise capture an audio environment all simultaneously or only some of them simultaneously, such utilizing F number of microphones simultaneously from a pool of H number of microphones, where F and H can be any number of 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40, or 50 or 60 or 70 or 80 or 90 or 100 (or any number therein, in increments of 1) providing that H is greater than F by at least 1. In an exemplary embodiment, some of the microphones can be statically located in the sound environment during the entire period of sampling, while others can move around or otherwise be moved around. Indeed, in an exemplary embodiment, one subset of microphones remains static during the sampling while other microphones are moved around during the sampling.

It is noted that in at least some exemplary embodiments, sampling can be executed once every or at least 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40, or 50 or 60 or 70 or 80 or 90 or 100 (or any number therein in increments of 1) seconds, minutes, or any variation thereof or any range therebetween in 0.01 second increments), during a given temporal period, and in some other embodiments, sound capture can occur continuously for or for at least 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, or 40, or 40, or 50 or 60 or 70 or 80 or 90 or 100 (or any number therein in increments of 1) seconds or minutes or hours or days. In some embodiments, the aforementioned sound capture is executed utilizing at least some microphones that remain in place and are not moved during the aforementioned temporal periods of time. In an exemplary embodiment, every time a sampling is executed, one or more or all of the method actions detailed herein can be executed based thereon. That said, in an exemplary embodiment, the sampling can be utilized as an overall sample and otherwise statistically managed (e.g., averaged) and the statistically managed results can be utilized in the methods herein. In an exemplary embodiment, other than the microphone(s) of the hearing prosthesis and/or the microphones of the smart phone(s) or other portable phones, the remaining microphones remain in place and otherwise are static with respect to location during a given temporal period such as any of the temporal periods detailed herein. That said, in some embodiments, the smart phones under the cell phones are also static with respect to position during the temporal periods. Indeed, in an exemplary embodiment, a smart phone or the like can be placed at a given location within a room, such as on a countertop or a night bureau, where that microphone of that device will be static for the given temporal period. Note also that static position is relative. By way of example, a microphone that is built into a car or the like is static relative to the environmental structure of the car, even though the car can be moving. To be clear, in at least some embodiments, while the teachings detailed herein have generally focused on buildings and the like, the teachings detailed herein are also applicable to automobiles or other structures that move from point to point. In this regard, it is noted that in at least some embodiments of automobiles and/or boats or ships and/or buses, or other vehicles, etc., there are often one or more built-in microphones in such apparatuses. For example, cars often have hands-free microphones, and in some instances, depending on the number of riders and the like, there can be one or two or three or four or five or six or more mobile phones in the vehicle and/or one or two or three or more personal electronics devices or one or two or three or more laptop computers, etc. Indeed, vehicles present exemplary scenarios of challenging listening scenarios or otherwise challenging conversational scenarios. Accordingly, the teachings detailed herein can have utilitarian value with respect to being utilized while the recipient of the hearing prostheses is in a vehicle, such as a car, traveling on a highway at highway speeds or on roads at road speeds, etc. In at least some exemplary embodiments, none of the microphones are moved during the period of time that one or more or all of the methods detailed herein are executed. In an exemplary embodiment, more than 90, 80, 70, 60, or 50% of the microphones remain static and are not moved during the course of the execution of the methods herein. Indeed, in an exemplary embodiment, such is concomitant with the concept of capturing sound at the exact same time from a different number of locations that are known. To be clear, in at least some exemplary embodiments, the methods detailed herein are executed without someone moving a microphone from one location to another. The teachings detailed herein can be utilized to establish a sound field in real-time or close thereto by harnessing signals from multiple mics in a given sound environment. The embodiments herein can provide the ability to establish a true sound field, as opposed to merely identifying the audio state at a single point at a given instant.

Consistent with the teachings detailed herein, owing to the ability to repeatedly sample an acoustic environment from static locations that remain constant, such as the ability to do so according to the aforementioned temporal periods and/or according to the number of times in the aforementioned temporal periods, the devices, systems, and/or methods herein can thus address and otherwise deal with a rapid change in an audio signal and/or with respect to an audio level associated with the recipient.

In an exemplary embodiment, methods, devices, and systems detailed herein can include continuously sampling an audio environment. By way of example only and not by way of limitation, in an exemplary embodiment, the audio environment can be sampled utilizing a plurality of microphones, where each microphone capture sound at effectively the exact same time, and thus the samples occur effectively at the exact same time.

In an exemplary embodiment, the central processor apparatus is configured to receive input pertaining to a particular feature of a given hearing prosthesis. By way of example only and not by way of limitation, such as in the exemplary embodiment where the central processor apparatus is a laptop computer, the keyboard can be utilized by a recipient to input such input. Alternatively, and/or in addition to this, a graphical user interface can be utilized in combination with a mouse or the like and/or a touchscreen system so as to input the input pertaining to the particular feature of the given hearing prostheses. In an exemplary embodiment, the central processor apparatus is also configured to collectively evaluate the input from the plurality of sound capture devices Consistent with the teachings above, as will be understood, in an exemplary embodiment, the system can further include a plurality of microphones spatially located apart from one another. In an exemplary embodiment, one or more or all of the microphones or located less than, more than or about equal to X meters apart from one another, where, in some embodiments, X is 0.1, 0.2, 0.3, 0.4, 0.5, 0.75, 1, 1.5, 2, 2.5, 3, 3.5, 4, 4.5, 5, 6, 7, 8, 9, 10, 11, 12, 13, 14, 15, 16, 17, 18, 19, 20, 21, 22, 23, 24, 25, 26, 27, 28, 29, 30, or more or any value or range of values therebetween in 0.01 increments (e.g., 4.44, 45.59, 33.33 to 36.77, etc.).

In an exemplary embodiment, consistent with the teachings above, the microphones are configured to output respective signals indicative of respective captured sounds. The system is further configured to provide the respective signals and/or modified signals based on the respective signals to the central processor apparatus as input from the plurality of sound capture devices.

Figure 6:
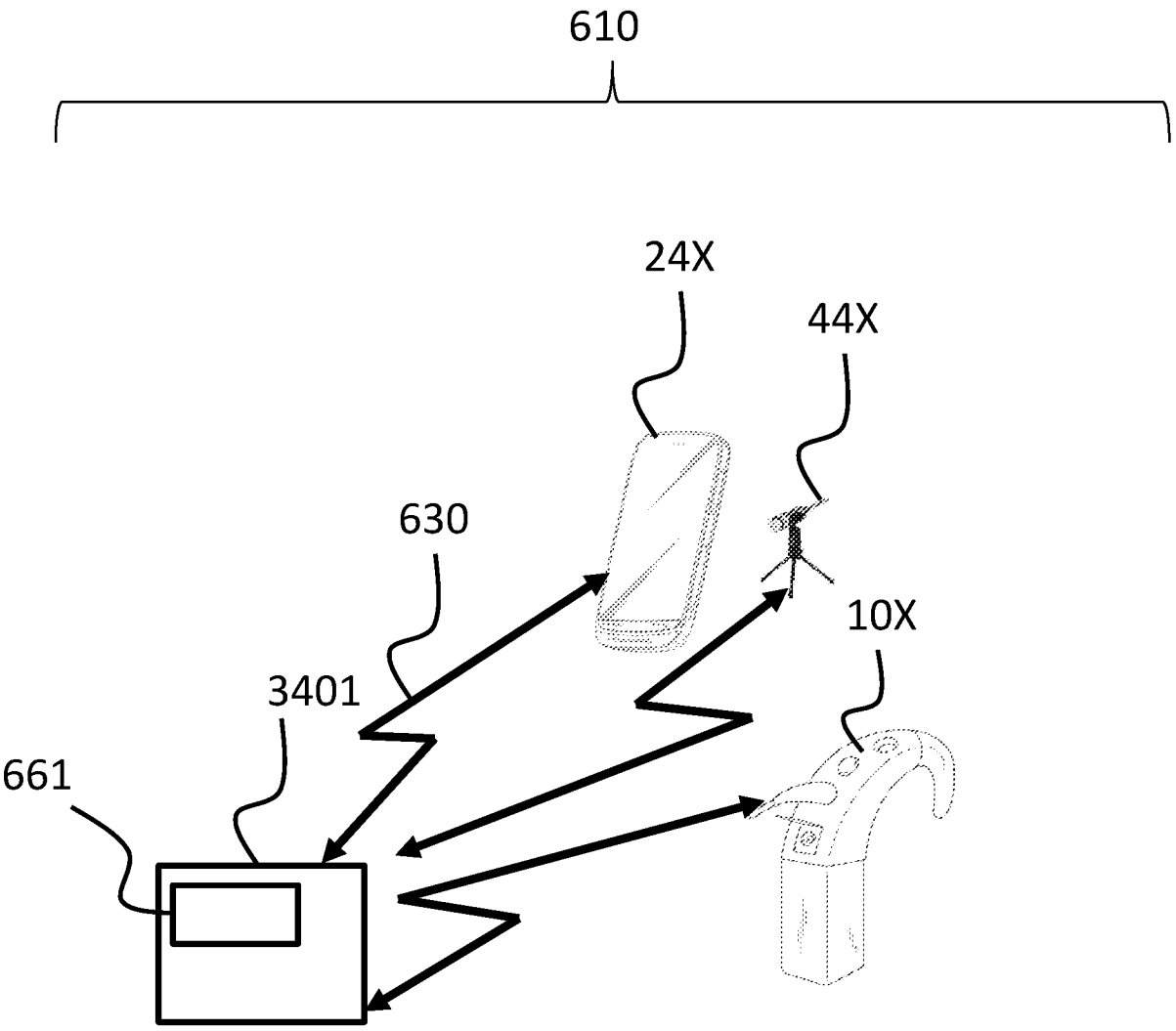
FIG. 6 presents another exemplary system according to an exemplary embodiment.

Consistent with the teachings above, embodiments include a system 310 of FIG. 3, or system 610 of FIG. 6, where various separate smart phones 240 or other types of consumer electronics products that include a microphone or in signal communication with the central processor apparatus 3401 via respective links 630, in an exemplary embodiment, the microphones of a given system can be microphones that are respectively part of respective products having utility beyond that for use with the system. By way of example only and not by way of limitation, in an exemplary embodiment, the microphones can be microphones that are parts of household devices (e.g., an interactive system such as Alexa, etc.), or respective microphones that are parts of respective computers located spatially throughout the house (and, in some embodiments, the microphones can correspond to the speakers that are utilized in reverse, such as speakers of televisions and/or of stereo systems) that are located in a given house at locations known to the central processor apparatus (relative or actual), and/or can be parts other components of an institutional building (school, theater, church, etc.). Still, consistent with the embodiment of FIG. 6, the microphones can be respective parts of respective cellular phones. In this exemplary embodiment, by way of example only and not by way of limitation, the microphones can be part of an Internet of Things.

In an exemplary embodiment, the cellular systems of the cellular phones 240 can be utilized to pinpoint or otherwise determine the relative location and/or the actual locations of the given cell phones, and thus can determine the relative locations and/or actual locations of the given microphones of the system. Such can have utilitarian value with respect to embodiments where the people who own or otherwise possess the respective cell phones will move around or otherwise not be in a static position or otherwise will not be located in a predetermined location.

In an exemplary embodiment, the embodiment of FIG. 6 utilizes a Bluetooth or the like communication system. Alternatively, and/or in addition to this, a cellular phone system can be utilized. In this regard, the link 630 may not necessarily be a direct link. Instead, by way of example only and not by way of limitation, the link can extend through a cellular phone tower where cellular phone system or the like. Of course, in some embodiments, the link can extend through a server or the like such as where the central processor apparatus is located remotely, geographically speaking, from the structure that creates the environment, which structure contains the sound capture device.

Still further, in at least some exemplary embodiments, the sound capture devices can be the microphones of the hearing prosthesis of given persons (10×—more than one prosthesis can be involved (e.g., where a person has a bilateral system, or where more than one person has a hearing prosthesis, etc.) where correlations can be made between the inputs therefrom according to the teachings herein and/or other methods of determining location. In some embodiments, the hearing prosthesis can be configured to evaluate the sound and provide evaluation data based on the sound so that the system can operate based on the evaluation. For example, as with the smart phones, etc., the hearing prosthesis can include and be configured to run any of the programs for analyzing sound detailed herein or variations thereof, to extract information from the sound. Indeed, in an exemplary embodiment, the sound processors of the prostheses without modification are configured to do this (e.g., via their beamforming and/or noise cancellation routines), and the prostheses are configured to output data from the sound processor that otherwise would not be outputted that is indicative of features of the sound. Also, sound processing capabilities of a given hearing prosthesis can be included in the other components of the systems herein. Indeed, in some aspects, other components can correspond to sound processors of a hearing prosthesis except where the processors are more powerful and/or have more access to more power.

FIG. 6 further includes a feature of the display 661 that is part of the central processor apparatus 3401. That said, in an alternative embodiment, the display can be remote or otherwise be a separate component from the central processor apparatus 3401. Indeed, in an exemplary embodiment, the display can be the display on the smart phones or otherwise the cell phones 240, or the display of a television in the living room, etc. Thus, in an exemplary embodiment, the system further includes a display apparatus configured to provide data/output according to any of the embodiments herein that have output, as will be described below.

It is noted that while the embodiments detailed herein depict two-way links between the various components, in some embodiments, the link is only a one-way link. By way of example only and not by way of limitation, in an exemplary embodiment, the central processor apparatus can only receive input from the smart phones, but cannot output such input thereto.

Figure 7:
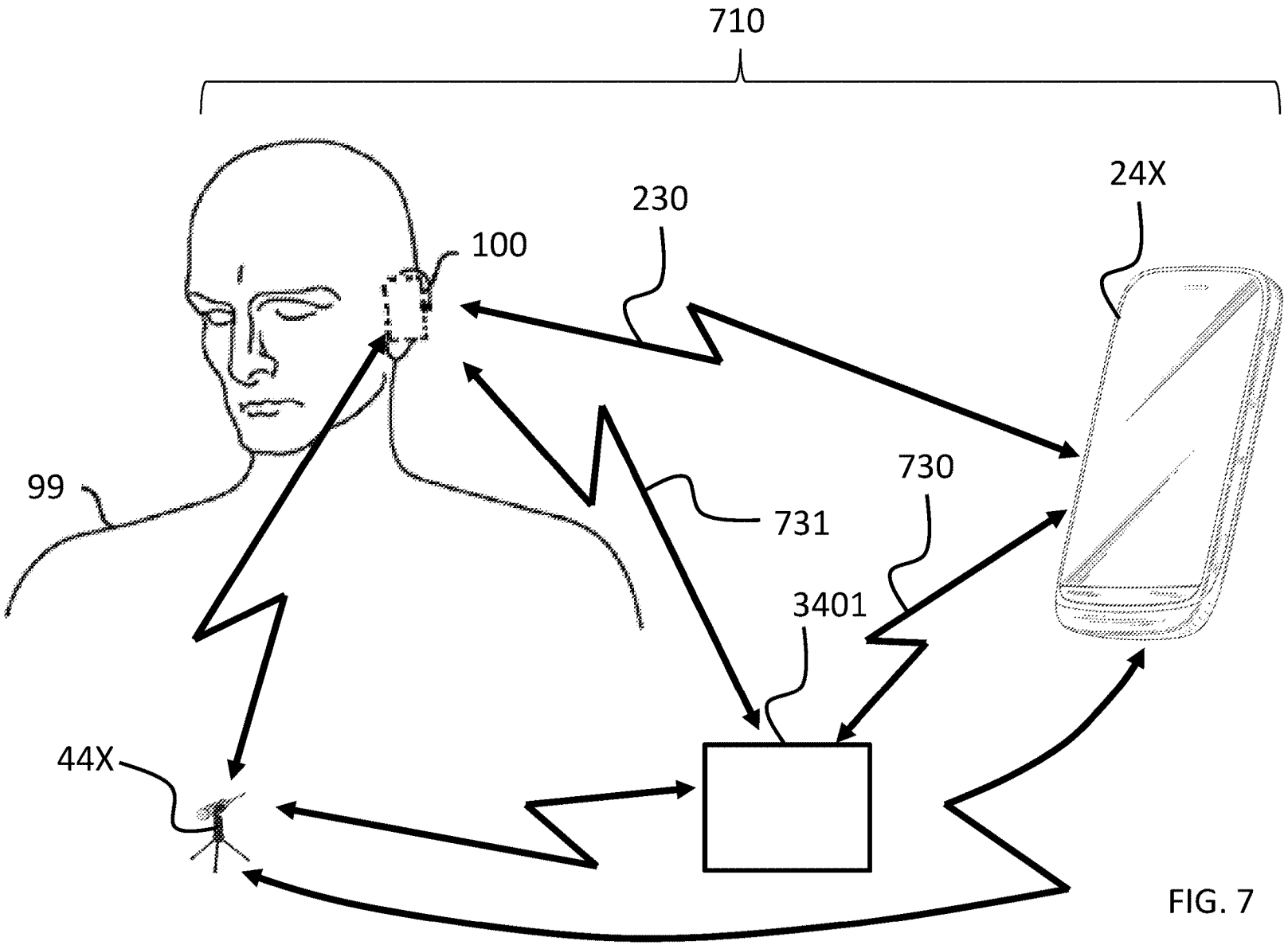
FIG. 7 presents another exemplary system according to an exemplary embodiment.

It is noted that while the embodiments of FIGS. 3-6 have focused on communication between the sound capture devices and the central processing assembly or communication between the sound capture devices and the hearing prostheses, embodiments further include communication between the central processing assembly and the prostheses. By way of example only and not by way of limitation, FIG. 7 depicts an exemplary system, system 710, which includes link 730 between the sound capture device 240 with the microphone (which here can correspond to the cell phone, but in some alternate embodiments, can correspond to the microphones that are dedicated to the system, etc.) and the central processing assembly 3401. Further, FIG. 7A depicts link 731 between the central processor apparatus 3401 and the prosthesis 100. The ramifications of this will be described in greater detail below. However, in an exemplary embodiment, the central processor apparatus 3401 is configured to provide, via wireless link 730, an RF signal and/or an IR signal to the prosthesis 100 indicating the spatial location that is more conducive to hearing. In an exemplary embodiment, the prosthesis 100 is configured to provide an indication to the recipient indicative of such. In an exemplary embodiment, the hearing prosthesis 100 is configured to evoke an artificial hearing percept based on the received input.

Note also, as can be seen, a microphone 44X is in communication with the central processor apparatus 3401, the prosthesis 100, and the smart phone 24X.

Figure 8:
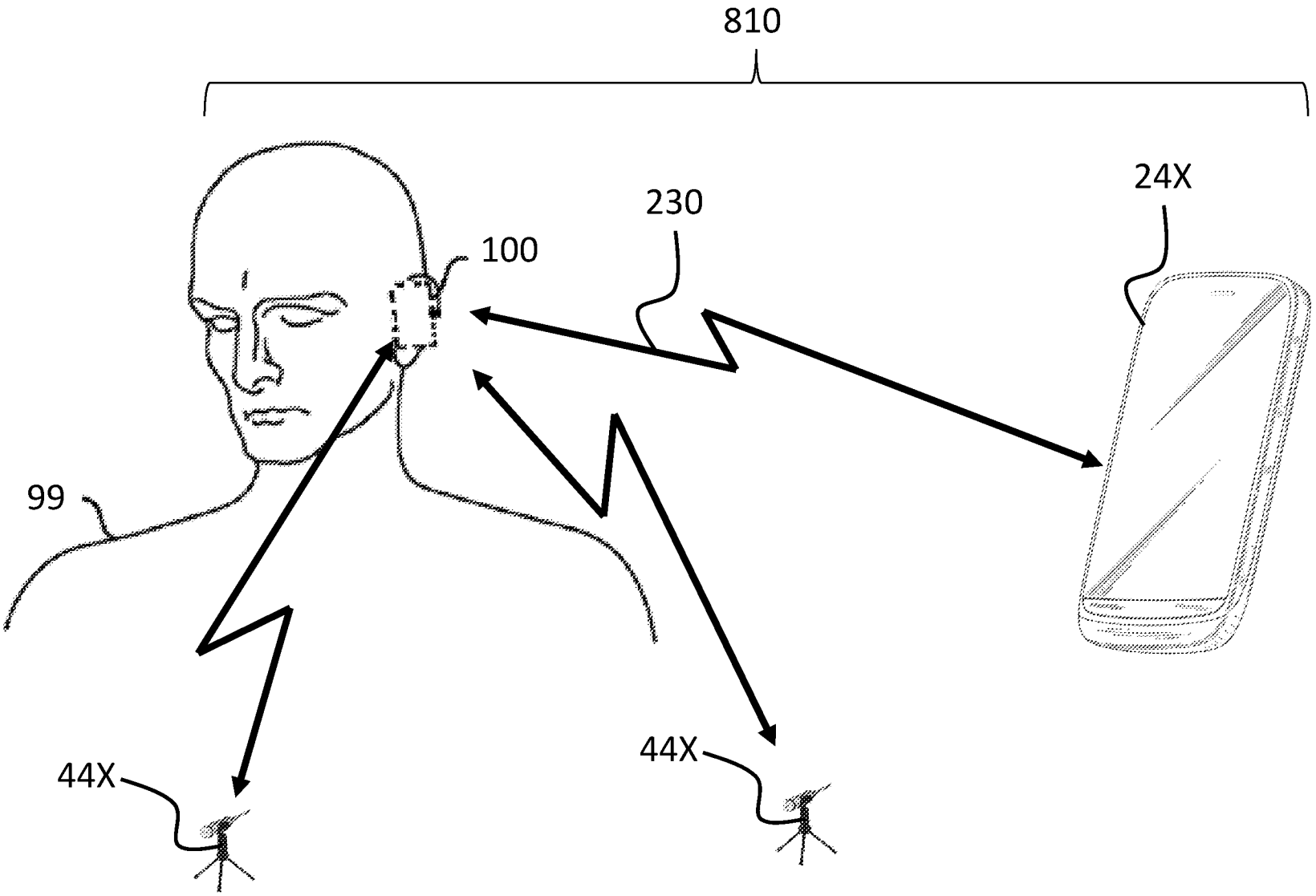
FIG. 8 presents another exemplary system according to an exemplary embodiment.

FIG. 8 depicts an alternate exemplary embodiment where the central processing apparatus is part of the hearing prostheses 100, and thus the sound captured by the microphones or otherwise data based on sound captured by the various microphones of the system are ultimately provided to the hearing prostheses 100. Again, it is noted that embodiments can also include utilizing microphones and other devices in vehicles, such as cars, etc., and can utilize the built-in microphones of such.

An exemplary scenario of utilization of the systems detailed herein can be a scenario where, for a child recipient, the child's mother and father are in the living room 505 and the mother is playing with the recipient while dad is talking on the phone in that same room. The Amazon Echo microphone 444 captures sound and the system determines that there is interaction between the mother and the child, and also determines that the father is essentially an interfering signal. The system can analyze the captured sound and determine that turn taking between the mother and the recipient is effectively different when the father is not talking at the same time as the mother relative to when the mother is talking at the same time that the father is talking. The system can provide feedback along the lines of an indication that it would be more utilitarian for the father to have the telephone conversation in another room, which could be provided in real time, or be provided later, where the feedback is that future telephone conversations should take place in separate rooms. In an exemplary embodiment, this can correspond to a text message to the father and/or mother's phone, can be an email to one or both, and/or can be a message placed on the television in the living room 505, etc.

Alternatively, the system could offer to apply a filter to the input of the sound processor to suppress the interference from the father during the duration of the phone conversation. (The suppression could also occur automatically.)

Thus, as can be seen, in an exemplary embodiment, the system is further configured to, based on the evaluation of the success of the communication, execute an action to improve the success of communication that is part of the communication and/or to improve a later communication. Moreover, as can be seen from the above, in an exemplary embodiment, the system is further configured to, based on the evaluation of the success of the communication, provide recommendations to improve a likelihood that future communications will be more successful, all things being equal.

Any device, system, and/or method of providing recommendations and/or taking action can be utilized in at least some exemplary embodiments providing that such has utility in the art enable such.

Another exemplary scenario can entail, again where the recipient is a child, a father of the recipient reading a bedtime story to the child recipient, where the child is in his bedroom 502. There are also conversations happening in the living room 505. The system has been updated with the spectral signature of inhabitants of the house, and thus can ascertain that the recipient is in the bedroom 502, and thus only monitors the bedroom 502. It monitors the interaction between the father and the child and detects only the fathers voice with little if any interaction with the child. The system also categorizes the child's breathing indicative of the child not being asleep. The rehabilitation system suggests tips for the father to make the reading more interactive to increase the development value of the activity.

In view of the above, it can be seen that in an exemplary embodiment, there is a system, comprising a first microphone of a non-prosthetic device and/or a non-body carried device. The system further includes a processor configured to receive input based on sound captured by the first microphone and analyze the received input. The received input can be directly from a microphone, and can be the raw output of the microphone, or can be a process signal, or can be data that is based on the signal and does not necessarily have to be an audio signal or audio data. Any data that can be utilized to implement the teachings detailed herein can be utilized in at least some exemplary embodiments.

In an exemplary embodiment, the system is configured to analyze the received input to determine whether the sound captured by the first microphone is indicative of an attempted communication between humans, which humans are located in a structure where the microphone is located. This as opposed to sound including speech that might be originating from a television or a radio or the like, or otherwise a human talking to himself or herself, or other sounds that a human may make that are not communication. In an exemplary embodiment, the system is configured to utilize any of the sound processing strategies detailed herein or variations thereof, such as, for example, voice to text conversion followed by text analysis, to evaluate the sound of the voice that was captured. This can be combined with spectral analysis of known voice patterns of the inhabitants of the house or the like, or other structure. Moreover, in an exemplary embodiment, the system can be periodically updated with data indicative of persons who are in the area/proximate the microphone/in the building, which can aid the system in determining whether or not a given captured sound is indicative of human communication.

Any device, system, and/or method that can be utilized to analyze data from a microphone or otherwise data based on sound captured by microphone that can enable the determination as to whether a given sound is indicative of an attempted communication between humans can be utilized in at least some exemplary embodiments. Thus, in an exemplary embodiment, the aforementioned central processor apparatus is programmed or otherwise configured to enable such evaluation the determination.

Further, in an exemplary embodiment, the system is configured such that, upon a determination that the sound is indicative of an attempted communication between humans, the system automatically evaluates the success of that communication. This can be enabled via an automated analysis of the content of voice that is captured by the microphone. In an exemplary embodiment, if the words that are captured are indicative of a conversation that is successful (e.g. a question is asked and an answer is provided) a determination is made that there was success in that communication whereas in an exemplary embodiment, if the words that are captured or indicative of a conversation that is not successful (e.g., a question is asked and no answer is provided or otherwise that there is silence, or one person is always talking with no voice data from another person, etc.), a determination is made that there was not success that communication. By way of example only and not by way of limitation, any of the algorithms that implement the Alexa system where the Amazon Echo system, or hands free dialing, etc., Can be utilized in at least some exemplary embodiments to evaluate speech that is captured by the microphone(s) and determine whether or not the speech is indicative of a conversation between humans and whether or not that conversation was successful.

Also, it is noted that in an exemplary embodiment, there is a system, comprising a first microphone of a non-body carried device and a processor configured to receive input based on sound captured by the first microphone and analyze the received input to determine whether the sound captured by the first microphone is indicative of an attempted communication to a human, which human is located in a structure where the microphone is located and upon a determination that the sound is indicative of an attempted communication to a human, evaluate the success and/or probability of success of that communication and/or effortfulness of the human to understand the communication.

In an exemplary embodiment, consistent with the teachings above, the sound captured by the first microphone indicative of an attempted communication to a human is a sound captured by the first microphone that is indicative of an attempted communication between humans, which humans are located in the structure where the microphone is located and the processor is configured to, upon a determination that the sound is indicative of an attempted communication between humans, evaluate the success of that communication (i.e., what is described in the preceding few paragraphs). That said, the evaluation can be the success and/or the probability of success of that communication. In this regard, it is to be understood that in at least some exemplary embodiments, there can be a correlation between the success of communication and/or the probability of success in communication and the efforts associated with understanding the communication. A low probability of success with respect to a communication can be indicative of a communication that is harder to understand or otherwise takes more effort to understand than that which would result from a communication that has a higher probability of success. Corollary to this is that more effort that it takes for a hearing prosthesis recipient to hear or otherwise understand/comprehend the hearing percepts that are being evoked based on the communications to him or her the quicker the recipient will become fatigued, all things being equal, which will have a domino effect with respect to lowering the likelihood that the recipient will be able to understand what is being told to him or her in later communications. Put another way, the more fatigued that the recipient becomes because he or she has had a harder time comprehending the communications to him or her, the more difficult it will be to understand later communications. Accordingly, in an exemplary embodiment, the probability of success of the communication can be utilized as a proxy for how "effortful" it is for the recipient to listen. More effortful hearing is typically not as utilitarian as less effortful hearing (although there are some scenarios where more effortful hearing is utilitarian, such as where the recipient is being trained or otherwise exercised to hear or more difficult sounds—roughly analogous to a weight trainer adding weights to a bench press bar, etc.). Thus, there can be utilitarian value with respect to identifying whether or not communication is communication that causes more effortful hearing, even if that communication is 100% of the time successful. To be clear, a communication that only has a 10% likelihood of being successful can still be successful. It will just be that that communication, to the extent that it was successful, with probably more effortful than that which would have been the case of the communication was deemed to be 80 or 90% likelihood of being successful.

To be clear, in at least some exemplary scenarios, hearing impaired listeners may utilize strategies and/or signal improvement techniques that can not only help with receiving a given message, but also help with the ease that the message is received. This can relate to how effortful the recipient finds listening and/or how tired the recipient becomes at the end of the conversation and/or even at the end of the day and/or by the middle of the day, etc. Accordingly, the aforementioned processors or the like can be configured to evaluate the data and determine how effortful it is for the recipient to engage in the communication. This can be done utilizing machine learning or the like or a trained neural network, etc. any arrangement that can enable such can be utilized at least some exemplary embodiments. Further, statistical analysis can be utilized.

It is noted that with respect to "indicative of an attempted communication to a human," this could be machine to human communication, such as, for example, sound which results from a television, or a radio, or a telephone, or an alarm (e.g., smoke detector that has a voice alarm, for example), or an automated direction system, or an audio book, etc. Also, in some embodiments, the sound is non-voice based. Some exemplary embodiments that utilize non-voice based sound can also be a smoke detector, or an oven timer, or a clock chime (broad meaning of an alarm) or an alarm clock, etc.

In this regard, in an exemplary scenario, an interaction can take place along the following lines. Person A is located in living room 505, and, shouts some instruction to a recipient in dining room 506. In an exemplary scenario of the utilization of the systems according to the teachings detailed herein, the system detects person A's voice and identifies it as an instruction based on any content recognition techniques that can be utilized or any other system that can be utilized. Thus, the system has made a determination that the sound captured by one or more of microphones 444, 442, and/or 443 is indicative of an attempted communication between humans. The system also detects or otherwise determines that there is a lack of response to person A. Thus, the system evaluates the success of that communication as being unsuccessful. Conversely, in an alternate scenario, the system detects person A's voice and identifies it as conversation with an intimate object (e.g., shouting at a television during a televised sporting event being shown on the television, a child talking to a doll or the like, etc.). The system determines that the sound captured is not indicative of attempted communication between humans, but instead is indicative of whatever one might classify such conversations with an inanimate object, and thus even though the television or the doll does not talk back to person A, there is no issue associated with the success of that communication.

Still further in the exemplary scenario where person A is shouting an instruction from room 505 to room 506, in an exemplary embodiment, simultaneously or in close proximity to this, the system can also take a measurement of the signal-to-noise ratio in one or more of the rooms of the house, and thus can ascertain a signal to noise ratio associated with microphone 441 in the dining room 506. The system can make a determination that the signal-to-noise ratio in room 441 is too low for easy detection of voice. In an exemplary embodiment, the system switches into relay mode and relays the instruction through a smart microphone or device (e.g., Alexa) that is in the same room as the recipient. The recipient acknowledges the instruction and moves to Person A to continue the conversation.

In view of the above, it can be seen that the aforementioned system, which includes a first microphone of a non-prosthetic device and/or a non-body carried device, includes a processor configured to receive input based on voice captured by the first microphone and analyze the received input in real time to identify a change to improve speech perception by a recipient of a hearing prosthesis. In real time, in a scenario where the change can be implemented almost immediately (which includes immediately) upon the identification of the change, the change can influence the current communication between two or more people. For example, in the scenario detailed above, where there is no response to person A's initial instruction, it is likely that person A will repeat the instruction, and if the changes implemented prior thereto, the current communication between the two people are influenced. This as opposed to a scenario where the given instruction was made, and hours later, another given instruction is made, and because of the change, the instruction is recognized. This is not to say that an embodiment implemented in real time would not have such results. This is to say that without the real time implementation, the repeats of the instruction in close temporal proximity to the initial instruction would not be influenced by the change.

In view of the above, it can be seen that in at least some exemplary embodiments, the first microphone of the system detailed above that is a non-body carried microphone is a microphone that is part of a stationary home consumer electronics device, such as, for example, a microphone of a desktop personal computer and/or a microphone of an Alexa device, etc. Further, in an exemplary embodiment, the first microphone can be part of a smart device, such as an Alexa device. Again, concomitant with the teachings detailed above, a plurality of microphones can be part of the system, which plurality of microphones are microphones of non-prostheses devices, which microphones are located at different spatial locations in a structure, such as a home or office building or a school. In at least some exemplary embodiments, the microphones are in signal communication with the processor, whether that is via a direct system utilizing Wi-Fi or the like, where via an indirect system, the microphones with the devices associated therewith are in signal communication with the processor via the Internet or the like. Again, any arrangement that can be utilized to implement the teachings detailed herein can be utilized in at least some exemplary embodiments.

Still, as noted above, it is also entirely possible that some embodiments include utilization of a microphone that is carried by the recipient and/or a microphone that is carried by the speaker or other person (in some embodiments, there are more than one hearing impaired persons in the house/car/office/building, etc. —embodiments include executing method actions and using the devices to execute the functionalities thereof where there are two, three, four, five, six or more hearing impaired persons in the structure, etc.), such as by way of example only and not by way of limitation, the microphone of the behind the ear device of a cochlear implant or an implanted hearing prosthesis and/or an in the ear microphone of a hearing prosthesis. Thus, in an exemplary embodiment, there is a system that includes, in addition to the first microphone with the plurality of the first microphones, a second microphone that is part of a hearing prosthesis. In an exemplary scenario of use of such system, again referring to this scenario where person A shouts to a person in another room, say in a scenario where person A is in room 505, and the recipient of the hearing prostheses is in room 503, which does not contain a stationary microphone that is part of the system, the comparison can be made of the signal-to-noise ratio in room 503 based on output of the microphone of the hearing prostheses, and/or, in an embodiment where the recipient is carrying a smart phone or the like, or where the smart phone is located in room 503, based on the output of the microphone of the smart phone.

One could envision a scenario where the microphone of the hearing prosthesis is always utilized and in some instances, is solely the microphone that is utilized for the system, where the signal-to-noise ratio is constantly analyzed, and upon a determination that the signal-to-noise ratio is high, the system could indicate that an action should be taken to lower the signal-to-noise ratio. However, this does not take into account the possibility that the recipient wants a high signal-to-noise ratio in the environment which he or she is in at the current time. Hence the utilization of other microphones and other parts of the system and the processing capabilities and programming of the system to evaluate whether or not conversation has been attempted to take place. Indeed, in an exemplary embodiment, the bulk of the recipient's non-sleeping existence could be associated with non-conversation time, and thus it would be less than utilitarian to be constantly reducing or otherwise making adjustments to the recipient's environment when conversation is not taking place. Accordingly, in an exemplary embodiment, the teachings detailed herein enable a system that is for the most part unobtrusive, temporally speaking, until there is utilitarian value for the system to be obtrusive.

Another exemplary scenario of utilization of the system can be as follows. With respect to an adult recipient, the recipient could ask her Apple HomePod to start reading an audiobook as a listening exercise (an exercise that will help rehabilitate and/or habilitate her hearing ability). In an exemplary embodiment, the recipient is located in room 504, and the system according to the teachings detailed herein is configured with programming to enable the recipient to indicate that she has missed a word of the like and have the missed words repeated, such as by simply saying out loud, "repeat," when she misses a word for a plurality of words. The system can further utilize directional microphones to make sure otherwise improve the likelihood relative to that which would otherwise be the case that it is monitoring her speech in a utilitarian manner with respect to the temporal period associated with listening to the audiobook or otherwise while the audiobook is playing. In an exemplary embodiment, the system is configured to monitor her requests to repeat and/or also configured to monitor a level of environmental noise and/or otherwise monitor other features that can impact her ability to hear or otherwise perceive sound around her. The system is configured to attempt to correlate sounds that are not associated with the audiobook, such as by way of example only and not by way of limitation, the sound of the washing machine in room 501 and the recipient missing certain words. The system thus executes an analysis of the captured sound, and utilizing its programmed logic, suggests using a more directional microphone setting and/or suggests that the recipient should practice or otherwise execute additional speech in noise exercises and/or suggest that the recipient should move to another room that is more distant from the washing machine and/or shut the door and/or shut the washing machine off or put the washing machine on a delayed cycle etc.

In view of the above, it can be seen that the processor of an exemplary embodiment can be configured to receive input based on voice captured by the first microphone (such as the "repeat" command) and analyze the received input in real time to identify a change to improve perception by a recipient of a hearing prosthesis.

Briefly, the episode with the washing machine leads to another aspect of another embodiment. In addition to the microphones located in the house, data can be obtained from other sources. In this regard, with the advent of smart devices and integrated home appliances, the system can receive input indicative of whether or not a certain devices on, such as, for example, whether or not the washing machine or the dryer or the house air conditioning fan is operating, etc. these appliances can communicate with the system and indicate whether or not such noisemaking devices are operating, which data can be also utilized by the system. This data can be analyzed by the system and further determinations can be made based on the data. Again, concomitant with a system that can utilize the Internet of things, the system can obtain data from multiple sources, which sources are not associated with sound/non-microphone sources, for utilization in accordance with the teachings detailed herein. In an exemplary embodiment, applications that are associated with a smart phone or a personal electronics device the like, that enable monitoring or the control, etc., of household appliances, can be modified or otherwise included as part of the system so as to obtain data indicative of whether the systems of the like are operating. Other devices can be utilized as well to determine whether such is operating. By way of example only and not by way of limitation, an amp meter can be associated with the 220-volt electrical circuit on which a dryer is located (likely the only device on that circuit), and upon a finding that electricity is flowing through the circuit, a determination can be made that the dryer is operating. Any arrangement that can enable data that is based on non-microphone components to be obtained and utilized in an automated manner to implement the teachings detailed herein in a utilitarian manner can be utilized in at least some exemplary embodiments.

In view of the above, it can be seen that the system according the teachings detailed herein can be configured to receive second input based on data that is not based on sound captured by a microphone, which data is indicative of an operation of a device within a structure in which the recipient is located, and, analyze the received second input along with the received input in real time to identify a change to improve perception by a recipient of a hearing prosthesis.

Referring back to the exemplary embodiment where the processor is configured to identify change to improve the perception by a recipient of the hearing prosthesis, in an exemplary embodiment, the change is a change in an action of a party associated with the speech to improve speech perception by a recipient of a hearing prosthesis. In an exemplary embodiment, the change in the action of the party is to have the father going to another room and/or to shut a door while he is speaking on the telephone. In an exemplary embodiment, the change in the action of the party is to have the father do certain things that make the reading more interactive such as, for example, by asking questions of the child during the reading effort (in the embodiment where the speaker is far from the recipient, the change in the action of the party could be a shouted instruction to have the speaker move closer to the recipient, etc.).

It is noted that the change can be a change to a device that is part of the system to improve speech perception by a recipient of the hearing prosthesis, such as, for example, with respect to the system switching into a relay mode where the instruction shouted by person A is relayed to the smart device in the room where the recipient is located. That smart device becoming part of the system or otherwise being part of the system.

In an exemplary embodiment, the change is a change to hearing prostheses. In an exemplary embodiment, this can be to utilize the more directional microphone setting as noted above in the exemplary scenario where the woman is utilizing the Apple HomePod. This can include adjusting a gain of the prosthesis, the enabling of a noise cancellation system, a scene classification system, or any other adjustment to the prosthesis that can have utilitarian value.

As noted above, an exemplary embodiment includes a system configured to provide an indication to the recipient and/or to others associated with the recipient of a change that can be executed to improve perception by a recipient of the hearing prostheses. The change can be any of the changes detailed herein. As noted above, the system can provide an email or the like to any pertinent party, or can display a message on a television or the like or on a display screen of a smart device or a non-smart device. Further, an audio message can be provided such as through a speaker on a television or a stereo or on a smart device, etc. Moreover, a message can be provided via the hearing prostheses. The message can be based on a hearing percept evoked by the prosthesis. Any arrangement that can be utilized to provide an indication of a change to a party can be utilized in at least some exemplary embodiments.

Moreover, in an exemplary embodiment, the system can be configured to execute an interactive process with the recipient and/or others associated with the recipient to change the status of a device that is part of the system. Referring to the above exemplary scenario where the system suggests utilizing a more directional microphone, an exemplary embodiment, the system is programmed to "offer" to implement directional microphone usage or otherwise adjusted directionality of the microphone. By way of example only and not by way of limitation, the system could present an audio message to the recipient, either directly via the prostheses, or via a general speaker that is in the room with the recipient, such as "would you like microphone directionality to be implemented." The recipient could say out loud, "yes," and the system would capture the sound of the "yes" utilizing one of the microphones of the system, and thus implement directionality accordingly. Again with reference to another one of the scenarios detailed above, where the system detects that the father is speaking on the phone in a manner that is less than utilitarian with respect to communication between the mother and the child, the system could offer to one of the parents to apply filter to the input of the sound processor of the hearing prosthesis to suppress the interference from the father's voice, at least for the duration of the phone conversation. In an exemplary embodiment, this can correspond to the presentation of an audio message from a speaker in the room in which the mother and child is located, and a message on the television screen in the room in which the mother and child is located, as can be a message to the mother's cell phone that could appear on the screen via text of the like, and the phone can be set to vibrate or provide some type of minor audio indicator to indicate that a message has come through, and/or could also be a message to the father indicating that the father's voice is less than utilitarian with her back to the conversation between the mother and child, and prompting the father to provide authorization to implement the filtering.

Alternatively, the system could simply automatically implement the filtering or the change to the system, etc., and indicate to the pertinent parties that such has occurred, and potentially ask a pertinent party whether or not the change is to be rescinded, and upon receipt of such recension, the change would be deleted or otherwise the system could revert to its status ante.

As seen above, embodiments can utilize output devices such as speakers and display screens to communicate with the parties. Accordingly, these components can also be part of the system in at least some exemplary embodiments. Again, such is consistent with the concept of the Internet of things.

Another exemplary scenario of utilization of the system could entail a recipient having a dinner conversation with some friends or relatives, the two not necessarily being mutually exclusive. The system can detect that the recipient is having difficulty hearing a person on his non-implanted side, at least when there exists the occurrence of background noise. In an exemplary embodiment, the system automatically extracts a spectral signature of the person's voice (the person on the non-implanted side) and automatically applies a boost to the voice or otherwise to sounds having that spectral signature or a signature close thereto and/or the system lowers the volume of a device that is making noise that is in the background, such as for example, a stereo or a television, thereby increasing the signal-to-noise ratio.

In this exemplary embodiment, it can be seen that the system has the ability not only to obtain data and information from devices in a house or a building, and/or to communicate or to utilize those devices to communicate with the parties, but also the system has the ability to control or otherwise exert some authority over the devices and the building. Accordingly, in an exemplary embodiment, the system is configured to control components that are unrelated to the hearing prosthesis of the recipient or otherwise unrelated to sound capture for hearing. Thus, in an exemplary embodiment, the system is configured to identify a change, where the change is a change to a device in a home that is unrelated to a hearing prosthesis and unrelated to sound capture to obtain data upon which a hearing percept evocation by the hearing prosthesis is based. For example, a change to a television or a stereo or a radio can be identified, which change can correspond to adjusting a volume thereof or otherwise turning the device off. In an exemplary embodiment, the device is an appliance. In an alternate embodiment, the device is a fixture, such as a window. In an exemplary embodiment, the change can be the closing of a window. In an exemplary embodiment, the change can be a deactivation of a house fan or a fan of a central air-conditioning unit. In an exemplary embodiment, the change can be the pausing of a washing machine or a dryer or a fan or an air conditioner, etc., temporarily. Note also that in at least some exemplary embodiments, the change can correspond to an increase in a volume of the device at issue, at least where the recipient is trying to listen to the device in a manner where the audio content is not streamed to the hearing prostheses.

Thus, as can be seen above, in an exemplary embodiment, the system is a system that includes various sound capture devices located around the home, various communication devices such as televisions and radios and display screens and phones or the like which can be used to convey information to various parties, and the system can also correspond to control components of fixtures and household appliances and consumer electronic appliances, etc., where the ability to control such to improve perception by a recipient can have utilitarian value.

Corollary to the above, it is noted that this systems are also configured to return a status of a component to the status ante before a change was made upon a determination by the system that the change is no longer utilitarian with respect to improving perception by recipient, at least with respect to the given logic that results of the change being implemented in the first instance. By way of example only and not by way of limitation, the system can continue to analyze the conversation, and upon a determination that the person to the recipient's non-implanted side is no longer located on the non-implanted side, for whatever reason, the system could then increase the volume of the music to that which was the case prior to the change. In a system where the system is configured to stop or otherwise pause the operation of a washer or dryer or house fan, upon a determination that the condition that prompted the determination that there could be a change to improve perception by the recipient is no longer present, the washer or dryer or house fan could be reactivated or otherwise bought back to its operational state corresponding to that which was the case prior to the change.

Some exemplary embodiments are directed towards automated systems as will be understood. Some embodiments can utilize sophisticated algorithms, such as artificial intelligence and machine learning, to recognize or extract intent/intention from voice that is captured by the microphones. In this regard, the system can be configured to identify and intent of the statement and try to determine whether or not subsequent sound that is captured is indicative of actors recognizing the intent and acting based thereon, which is an indicator that the speech has been perceived in a proper otherwise utilitarian manner. Indeed, in an exemplary embodiment, latent variables can be utilized to ascertain whether or not a recipient of a hearing prosthesis has comprehended or otherwise perceived in a utilitarian manner the sound about him or her. Any arrangement that can enable a determination as to whether or not a recipient is perceiving sound can be utilitarian.

Note also that while at least some exemplary embodiments have focused on the experience of voice or the like corresponding to the data being captured by the microphones, in some other embodiments, non-voice sound can be the basis of the data. Indeed, for example, if an alarm or an alert occurs, and the recipient fails to take action, this can be an indication that the recipient is not utilizing the hearing prosthesis to its fullest amount. Irrespective of alarms, consider the scenario where a glass falls on the ground and breaks or the like, or there is some other large noise. The system could record such or otherwise identify such is occurring and evaluate whether or not the recipient of the hearing prosthesis responded thereto. If the recipient did not respond to a sound that he or she otherwise should have responded to, based on the evaluation of the system, this can be a basis for the system to recommend changes or otherwise indicate that there is something about the recipient's habilitation and/or rehabilitation regime that is not producing certain desired results. Moreover, such can be the basis for an intervention, such as to ensure that the alert is being communicated and/or relay/replay/use a visual warning as a substitute, etc.). While the aforementioned exemplary scenario can be implemented in an automated manner, it is noted that in other exemplary embodiment, a data set can be evaluated for sharp noises or extraneous noises or the like in an automated manner, to identify such sharp noises or extraneous noises, and then a professional can manually perform an analysis to determine whether or not the recipient responded accordingly.

It is further noted that while the embodiments disclosed herein are directed towards capturing voice of various parties that live in a house or otherwise utilize a building or the like, other embodiments are directed towards focusing only on the voice of a recipient of a hearing prosthesis. Accordingly, some embodiments can specifically target the recipient of the prostheses to the exclusion of others vis-à-vis capturing sound or the like. In this regard, such embodiments can have utilitarian value with respect to limiting the amount of data that exists for methods that evaluate the recipient's speech to evaluate the ability of the recipient to hear. In other embodiments, multiple targets are identified, and the system obtains data on all of the targets, such as, for example, the recipient and anyone that is attempting communication to the recipient irrespective of whether or not microphone that is worn by the recipient detects the attempted communication.

Note further that there is utilitarian value with respect to the fact that multiple microphones are being utilized in some instances simultaneously, to capture the same sound. In an exemplary embodiment, the output of various microphones can be compared to one another, and the output that is most useful for a given sound is utilized and the others excluded, and/or the various outputs are collectively analyzed to make a determination as to the true occurrence of an event, whereas output from only one microphone might lead to false positives of the like.

It is noted that while the embodiments described herein are sometimes described in terms of affirmative control over a device by the system, in an alternate embodiment, the system could instead simply propose suggested actions along the lines of controlling these devices. By way of example only and not by way of limitation, the system could propose to the recipient to lower the music in the room, which would require the recipient to affirmatively control a volume of the music maker (which could simply correspond to the recipient saying out loud something like "lower volume of music," where the system could react to that command and thus lower the volume of music—again, all of this is consistent with the Internet of things or otherwise an integrated system, although it is noted that one single system need not necessarily be that which is utilized—the system for controlling the various appliances in the house or the like could be a separate system (e.g., a general system that is increasingly becoming common in houses irrespective of whether or not a recipient has an impairment of any kind) from the system that identifies the changes). Corollary to this is that the system could enact the action and then notify the parties that such has occurred, then ask whether or not the action should be countermanded. That said, in some embodiments, there may not necessarily be a request by the system as to whether or not the action should be countermanded. Instead, the system could simply provide an indication that such action occurred. The system could repeatedly remind the recipient that such is taking place. By way of example only and not by way of limitation, the system could periodically remind the recipient or other parties for that matter, that the washing machine has been stopped, thus placing the onus on the parties to reactivate the washing machine.

As noted above, the system can include or otherwise identify changes to devices in a building, which includes a home, school, a workplace, etc., which devices are unrelated to a hearing prosthesis. By way of example only and not by way of limitation, a remote control device for hearing prostheses, such as that to be a handheld wireless device, or a smart phone that is utilized to control at least in part the hearing prostheses, would be related to a hearing prosthesis. A remote microphone or the like that is dedicated for use with the hearing prostheses having no other purpose would also be a device that is related to a prosthesis. Further, by a change unrelated to sound capture to obtain data upon which a hearing percept evocation by the hearing prosthesis is based, a microphone in another room that is not utilized to evoke a hearing percept corresponds to such. This is distinguished from a microphone of the hearing prosthesis or a microphone of a smart phone or the like that streams an audio signal to the hearing prosthesis upon which a signal is based. Indeed, in an exemplary embodiment, the changes unrelated to a microphone, and/or unrelated to a device having a microphone.

In another exemplary scenario, the system can provide a more generalized information in terms of educating parties about how they might act differently or otherwise changes that could be made to enhance perception of the recipient, etc. In an exemplary scenario, referring to the above-noted dinner party, the system could provide information to the recipient or to a caregiver about the utilitarian value of bilateral implantation and/or strategies for positioning people at a dinner at a table or in a conference etc. In this regard, the system can be considered somewhat of a habilitation and/or rehabilitation tool in that it can aid the recipient or people associated there with in the long term to hear better. More on this below.

Figure 9:
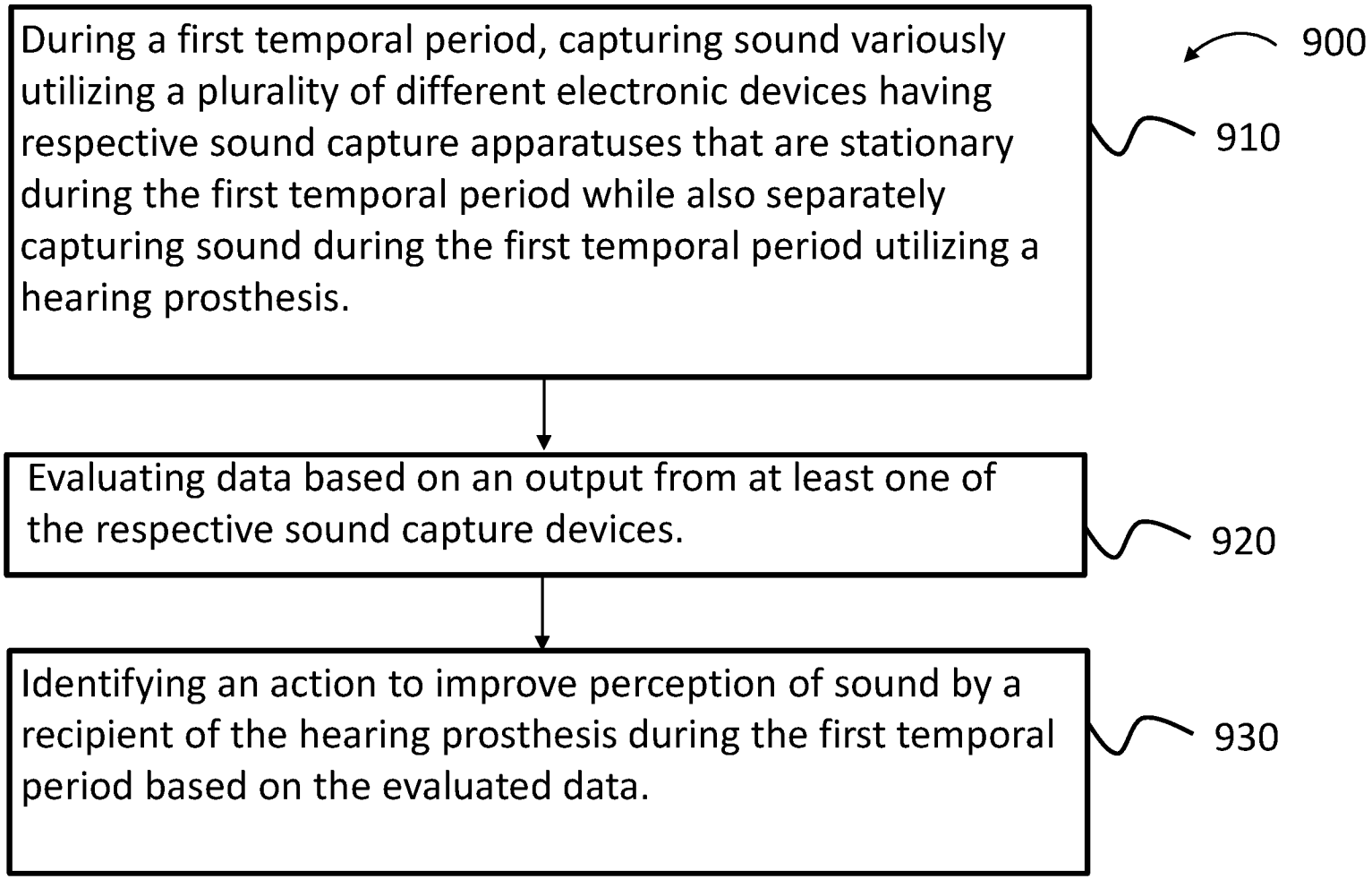
FIG. 9 present an exemplary flowchart for an exemplary method.

FIG. 9 presents an exemplary algorithm for an exemplary method, method 900, according to an exemplary embodiment. Method 900 includes method action 910, which includes, during a first temporal period, capturing sound variously utilizing a plurality of different electronic devices having respective sound capture apparatuses that are stationary during the first temporal period while also separately capturing sound during the first temporal period utilizing a hearing prosthesis. That said, in an alternate embodiment, method action 910 is executed utilizing one or more different electronic devices having respective sound capture apparatuses that are stationary during the first temporal period while also separately capturing sound during the first temporal period utilizing a hearing prosthesis.

The different electronic devices can correspond to any of those detailed above or herein, which sound capture apparatuses are stationary during the first temporal period. In an exemplary embodiment, a cell phone or a smart phone or even a telephone that is held by a recipient is not stationary, as there will be some movements associated there with. Conversely, the Alexa microphone or the microphone of a laptop computer or a microphone of a stereo system, etc., could be stationary during a first temporal period. Also, a microphone of a cellular phone or a smart phone laying on a table or the like could also be stationary. A microphone of a personal recording device that is carried by a recipient or a microphone of a hearing prosthesis would not be stationary unless the recipient is sleeping or something. In any event, method action 910 also specifically requires the action of also separately capturing sound during the first temporal period utilizing a hearing prosthesis. Accordingly, the plurality of different electronic devices would necessarily have to be different than a hearing prosthesis of the recipient (including a bilateral device, where, collectively, that is considered a hearing prosthesis, even though such might be two separate components having to separate sound processing systems in two separate microphones).

It is also noted that the sound captured variously utilizing the electronic devices need not necessarily be the same sound that is captured by the hearing prosthesis. Again, the above-noted scenario is referenced where person A is in the living room shouting to the recipient who is in another room. The microphone of the recipient's hearing prosthesis may not necessarily capture that sound that is shouting. It is further noted that the temporal period can have a length where the actions associated with the electronic device(s) vis-à-vis capturing sound need not necessarily occur at the same time or otherwise overlap, such as the case with a temporal period that extends for a number of seconds or a minute or so or longer. By way of example only and not by way of limitation, with respect to the scenario where the father is talking on the telephone, a scenario exists where the words of the father that are captured by the electronics device do not overlap with the words of the mother who is reading to or otherwise conversing with the child. That said, in some other scenarios, the sounds that are captured overlap temporally.

Method 900 further includes method action 920, which includes evaluating data based on an output from at least one of the respective sound capture devices. Here, it is not necessary that the sound captured by the hearing prosthesis be evaluated, although as will be described in greater detail below, in other embodiments, such is also evaluated. Indeed, in an exemplary embodiment, the system can function autonomously and separately from the hearing prosthesis. Accordingly, in an exemplary embodiment of some of the systems detailed herein, the system specifically does not include a hearing prosthesis and/or the system is not in signal communication with a component of a hearing prosthesis, while in other embodiments, as detailed above, the opposite is the case.

Method action 920 can be executed based on output from only one of the sound capture devices from only one of the electronic devices in a household of the like. Indeed, in an exemplary embodiment, the system could serially evaluate the output from different microphones, and method action 920 could entail the first evaluation from the plurality of microphones. Still further, in an exemplary embodiment, the system could focus on output from a particular microphone to the exclusion of others. To be clear, the mere fact that sound is captured from two or more microphones does not require that the sound captured by those microphones be evaluated with respect to method action 920. That said, in some embodiments, the output of all the microphones associated with a given system can be evaluated in some alternate methods. Any method of executing the teachings detailed herein can be utilized in at least some exemplary embodiments.

Method 900 also includes method action 930, which includes identifying an action to improve perception of sound by a recipient of the hearing prosthesis during the first temporal period based on the evaluated data. This can correspond to any of the actions detailed herein that so relate.

In an exemplary embodiment, the sound captured by the at least one of the respective sound capture devices is different than that captured by the hearing prostheses. Again, in a scenario where the microphone of the electronics device is located in one room and the recipient is located in another room, the possibility exists that the microphone of the hearing prosthesis does not capture the sound that was captured by the microphone of the consumer electronics device. That said, in some other embodiments, the sound captured by the devices are the same. Indeed, in an exemplary embodiment the sound is captured by the electronic device's microphone and by the hearing prosthesis, but the recipient of the hearing prosthesis does not have an evoked hearing percept based on sound captured by the hearing prosthesis or does not meaningfully perceive an evoked hearing percept based on sound captured by the hearing prosthesis. Thus, irrespective of the actions associated with the microphone, the end result could be the same: the recipient is not able to respond to the sound in a manner is utilitarian is that which would be the case if the recipient had any evoked hearing percept that was meaningfully perceived. Put another way, speech that is perceived as a mumble or a sound that could easily be perceived as a background sound (especially plausible with respect to a cochlear implant), is not something that is meaningfully perceived even if it is perceived.

Figure 10:
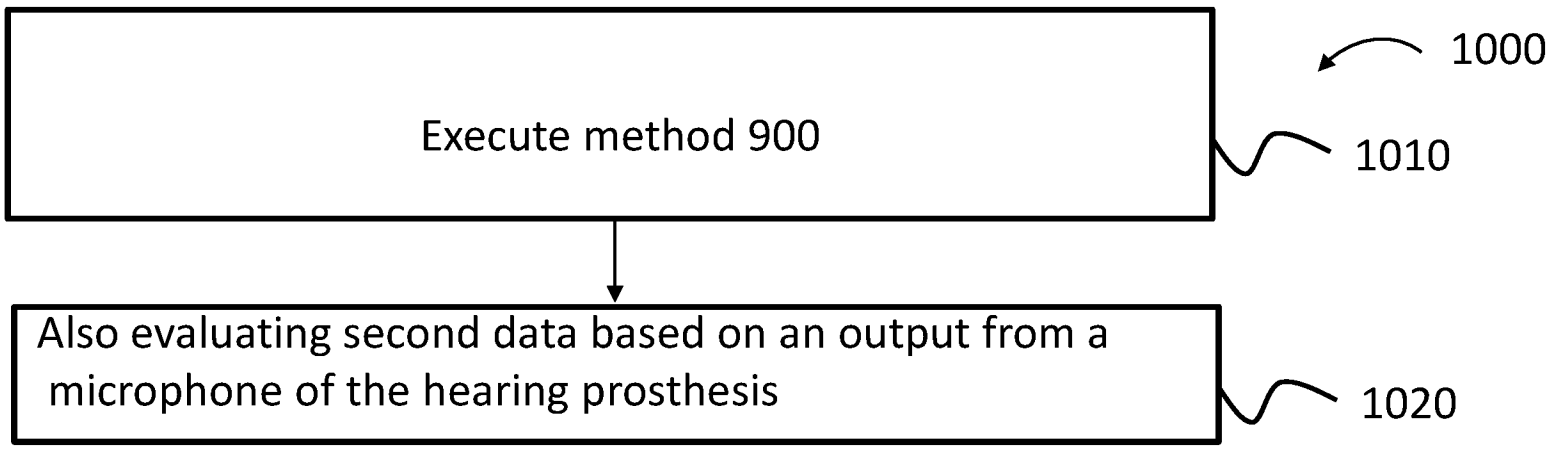
FIG. 10 present another exemplary flowchart for an exemplary method.

FIG. 10 presents an exemplary method, method 1000, for an exemplary embodiment, that includes method action 1010, which includes executing method 900. Method 1000 also includes method action 1020, which includes also evaluating second data based on an output from a microphone of a hearing prosthesis. Briefly, it is noted that the temporal order of the actions need not necessarily occur in the delineated order. In this regard, method 1000 includes a scenario where method action 1020 is executed before method action 930. Thus, any disclosure of any method actions herein corresponds to a disclosure of practicing or otherwise executing those method actions in any order that will result in utilitarian value, irrespective of the order of presentation in this disclosure, unless otherwise noted or unless the art does not enable such.

In an exemplary embodiment of method 1000, the action identifying an action to improve perception of sound by a recipient of the hearing prosthesis during the first temporal period is also based on the evaluated second data. In this regard, again referring to the exemplary scenario where person A is shouting from the living room, the hearing prosthesis recipient may reply in a manner that is not received by another microphone of the system other than that of the hearing prostheses (e.g., there is no microphone in the room where the recipient is located or the recipient speaking very softly, which might be the case in a scenario where the reply is with foul language stated "under his breath," etc.). Further, the recipient of the hearing prosthesis may not reply at all. Thus, the sound captured by the microphone would be analyzed to determine that there is no reply or otherwise that there is no acknowledgment of what was shouted from the living room. Accordingly, in embodiment, the microphone is part of the system that is utilized to execute method 1000. Thus, in some embodiments, there are methods that are executed where the microphones of the hearing prosthesis are part of the system and otherwise utilized to evaluate actions that can be taken, while in other embodiments, there methods that are executed where the microphones of the hearing prosthesis are not part of the system and/or are not otherwise utilized to evaluate actions that can be taken.

Concomitant with the teachings detailed herein, at least one of the electronic devices is a smart device that is not a body carried device. In an exemplary embodiment, none of the electronic devices are smart devices that are body carried devices. Conversely, in an exemplary embodiment, at least one of the electronic devices is a smart device that is a body carried device (e.g., a smart phone). In an exemplary embodiment, at least one of the electronics devices is a non-smart device that is a body carried device (e.g., non-smart phone).

As noted above, method 900 is a method that includes actions that are executed within a first temporal period. In an exemplary embodiment, the first temporal period is less than 0.01, 0.02, 0.03, 0.04, 0.05, 0.06, 0.07, 0.08, 0.09, 0.1, 0.125, 0.15, 0.175, 0.2, 0.3, 0.4, 0.5, 0.75, 1, 1.5, 2, 2.5, 3, 3.5, 4, 4.5, 5, 6, 7, 8, 9, 10, 11, 12, 13, 14, 15, 16, 17, 18, 19, 20, 21, 22, 23, 24, 25, 26, 27, 28, 29, 30, 35, 40, 45, 50, 60, 70, 80, 90, 100, 110, or 120 minutes or any value or range of values therebetween in 0.001 increments. In an exemplary embodiment, the actions of method 900 and method 1000 and/or any of the other actions detailed herein are executed in real time. That said, in an alternate embodiment, some actions of various methods are specifically not executed in real time with respect to other actions of the methods detailed herein.

Consistent with the teachings of utilizing household electronics devices, in at least some exemplary embodiments of method 900 and/or method 1000, at least one of the electronic devices has at least one other function beyond that associated with identifying an action to improve perception of sound by a recipient of the hearing prosthesis during the first temporal period based on the evaluated data. Again, in an exemplary embodiment, one of the electronic devices can be a smart phone or a smart device or a dumb device. In an exemplary embodiment, at least one of the electronic devices is solely related to capturing sound for the purposes of executing one or more the method actions detailed herein. This is consistent with the exemplary embodiment where the microphones are placed about a house for the sole purpose of executing the teachings detailed herein vis-à-vis sound capture for the purposes of improving recipient performance. Still, in an exemplary embodiment, the electronic devices are household devices, and method 900 and/or method 1000 further includes utilizing the electronic device from which the output of at least one of the sound capture devices is obtained to do something unrelated to the recipient of the hearing prosthesis. This could include utilizing a telephone as a telephone. This could include utilizing a speaker of a computer for dictation purposes.

In an exemplary embodiment, the action identified in method action 930 is a hearing habilitation and/or rehabilitation action. Some additional details of this will be described below. Conversely, in an exemplary embodiment, the action identified in method action 930 is an action that has immediate results with respect to improving perception of sound by the recipient. Again, such as automatically adjusting a gain of the hearing prosthesis or adjusting a beamforming feature of the hearing prostheses or introducing noise cancellation, we are proffering to the recipient or a caregiver or the like that such can happen. This as opposed to presenting the utilitarian value of bilateral implants and/or detailing how the recipient should that in future conversations, even if such is provided contemporaneously with the data that is obtained to make such determinations.

It is noted that any method action detailed herein corresponds to a corresponding disclosure of a computer code for executing that method action, providing that the art enables such unless otherwise noted. In this regard, any method action detailed herein can be part of a non-transitory computer readable medium having recorded thereon, a computer program for executing at least a portion of a method, the computer program including code for executing that given method action. The following will be described in terms of a method, but it is noted that the following method also can be implemented utilizing a computer code.

Figure 11:
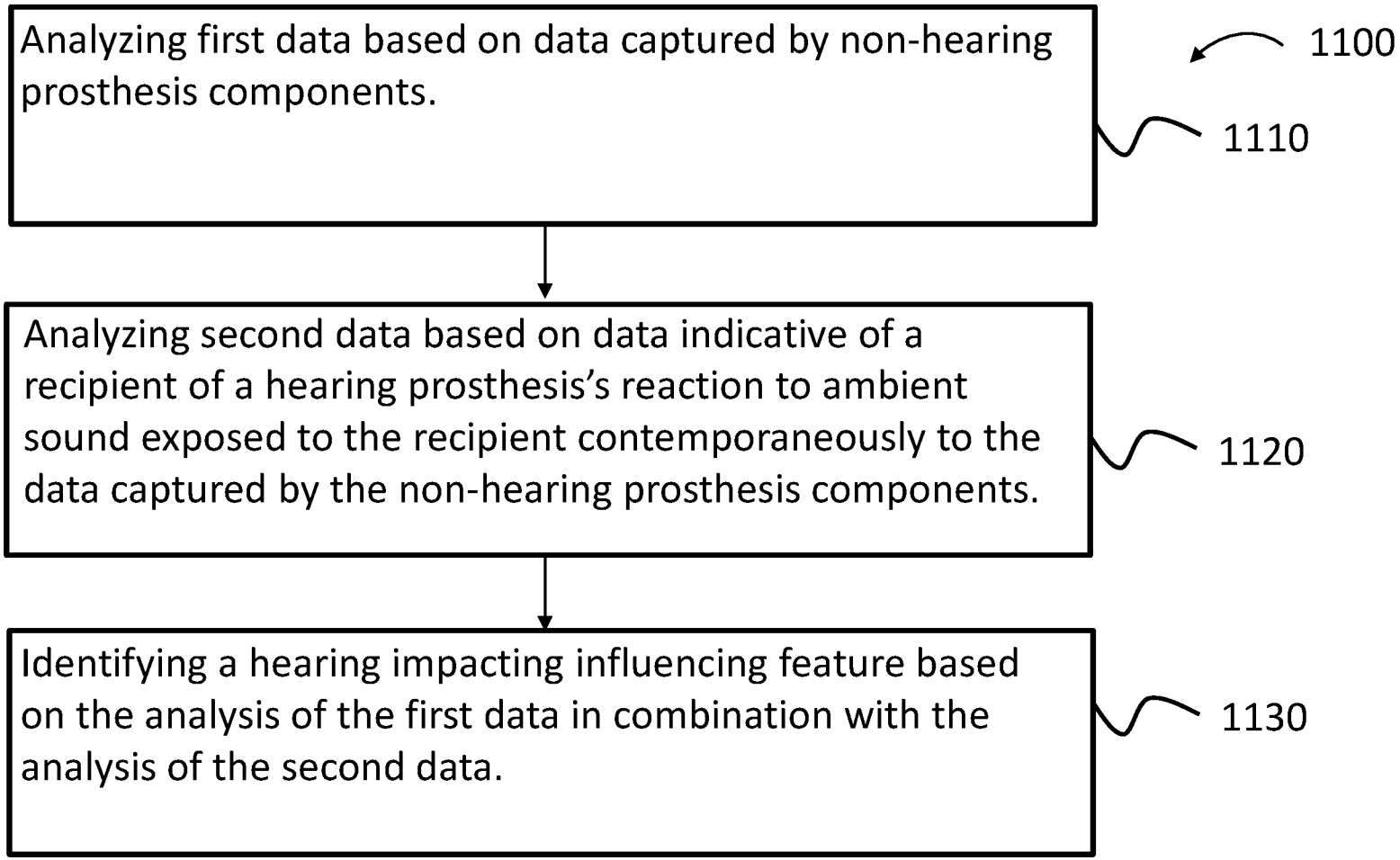
FIGS. 11 and 12 present additional exemplary flowcharts for exemplary methods.

In this regard, FIG. 11 depicts an exemplary algorithm for an exemplary method, method 1100, which includes method action 1110, which includes analyzing first data based on data captured by non-hearing prosthesis components. Briefly, consistent with the embodiments that involve a computer readable medium, in an exemplary embodiment, there is code for code for analyzing first data based on data captured by non-hearing prosthesis components. In any event, method action 1110 can be based on data that is captured by any of the microphones detailed herein that are part of the electronics devices that are located at various locations around the building. In an exemplary embodiment, the method further includes evaluating various inputs and determining whether or not the input corresponds to data based on data that is captured by non-hearing prostheses component or whether it is data that is based on data that is captured by a hearing prosthesis component. In this regard, in an exemplary embodiment, the various inputs into the central processor apparatus can be tagged or otherwise include a code that indicates where the data was ultimately received. Alternatively, and/or in addition to this, the central processor apparatus can be configured to evaluate the ultimate source of the data based on an input line relative to another input line of the system, etc.

By data based on data, it is meant that this can be the raw output signal from the microphone, or can be a signal that is generated that is based on the signal from the microphone, or can be a synopsis or a summary, etc., of the raw output from the microphone. Thus, data based on data can be the exact same signal or can be two separate signals, one that is based on the other.

Method 1100 further includes method action 1120, which includes analyzing second data based on data indicative of a recipient of a hearing prosthesis' reaction to ambient sound exposed to the recipient contemporaneously to the data captured by the non-hearing prosthesis components. Again, in an exemplary embodiment relating to a non-transitory computer readable medium, there is code for analyzing second data based on data indicative of a recipient of a hearing prosthesis's reaction to ambient sound exposed to the recipient contemporaneously to the data captured by the non-hearing prosthesis components.

Method action 1120 can be executed in accordance with any of the teachings detailed herein. Again, lookup tables or preprogrammed logic or even artificial intelligence systems can be utilized to implement method action 1120.

In an exemplary embodiments of method action 1120, there is the exemplary scenario where the father is reading to the child, and the child is not responding. Method action 1120 can thus entail analyzing the sound captured by a microphone of the system to identify whether or not the child is responding or how the child is responding. Again, if a determination is made that the child is not responding, the analysis of method action 1120 can be that there is a less than utilitarian occurrence going on with respect to the temporal periods associated with this method action.

It is briefly noted that the second data can be data from the hearing prosthesis or can be data from the same microphone associated with method action 1110, or both, or from three or more sources. Indeed, in an exemplary embodiment, method 1100 is executed irrespective of the input and/or output associated with the hearing prostheses. Method action 1110 can be executed by system that relies solely on non-hearing prostheses components and/or non-body worn microphone devices, and/or a non-body carried microphone devices, etc. It is also briefly noted that any disclosure herein of a body worn or body carried device can correspond to a disclosure of a non-body worn and/or non-body carried device unless otherwise noted providing that the art enables such, and vice versa. Any disclosure herein of any first device with a microphone corresponds to a disclosure of any the other devices herein that are disclosed as having microphones unless otherwise noted providing that the art enables such. That is, any method action detailed herein or any system and/or device that discloses one type of component that has a microphone corresponds to a disclosure where that one type of microphone is substituted for another type of microphone or another type of device, etc.

Method 1100 further includes method action 1130, which includes identifying a hearing impacting influencing feature based on the analysis of the first data in combination with the analysis of the second data. Again, concomitant with the fact that various method actions detailed herein can correspond to a disclosure of code for executing those method actions, in an exemplary embodiment, there is a non-transitory computer readable medium having recorded thereon, a computer program for executing at least a portion of the method, the computer program including code for identifying a hearing impacting influencing feature based on the analysis of the first data in combination with the analysis of the second data.

Figure 12:
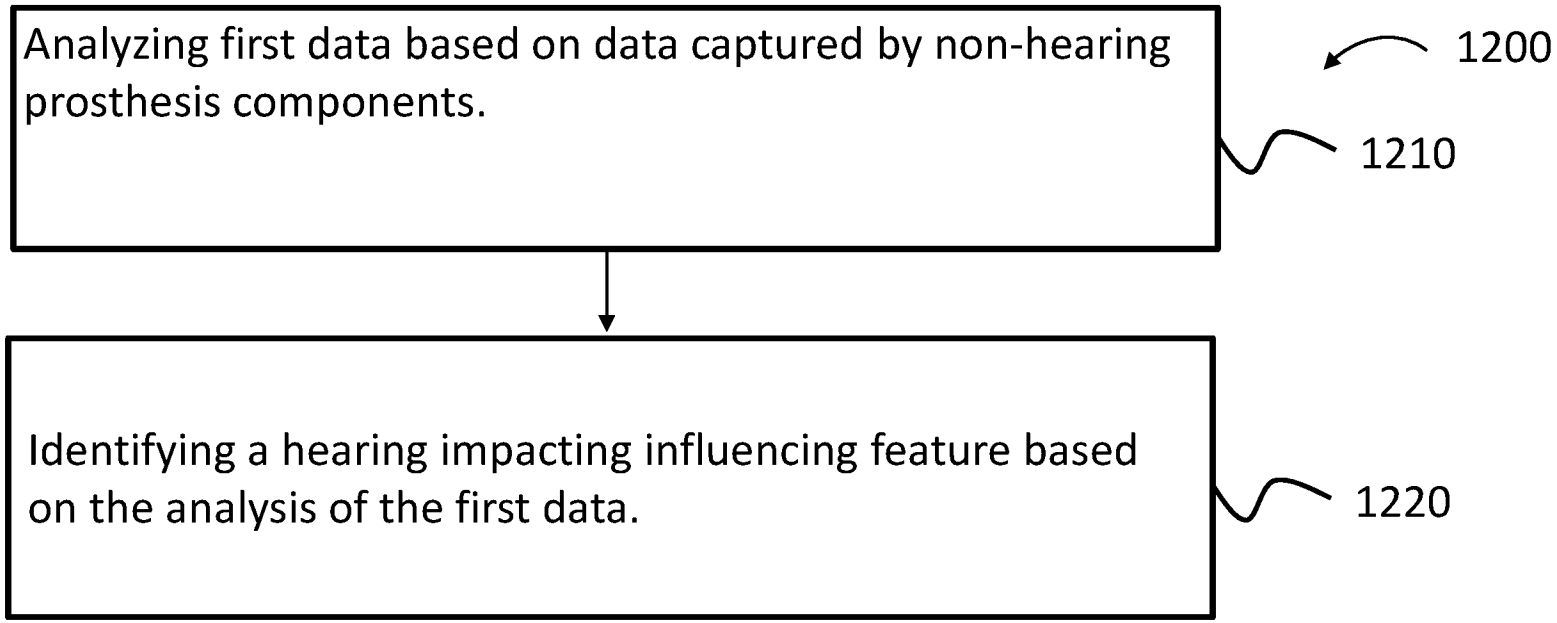

The above said, FIG. 12 presents an exemplary algorithm for an exemplary method, method 1200, which is broader than that of FIG. 11. In this regard, the method includes method action 1210, which includes analyzing first data based on data captured by non-hearing prosthesis components. Briefly, consistent with the embodiments that involve a computer readable medium, in an exemplary embodiment, there is code for code for analyzing first data based on data captured by non-hearing prosthesis components. In any event, method action 1210 can be based on data that is captured by any of the microphones detailed herein that are part of the electronics devices that are located at various locations around the building.

Method 1200 further includes method action 1220, which includes identifying a hearing impacting influencing feature based on the analysis of the first data.

A hearing impacting influence feature can be any of the features detailed herein, such as background noise, positioning of speakers, habilitation and/or rehabilitation regimes, etc.

In an exemplary embodiment associated with method 1100 and/or method 1200, there is the action of determining whether the first data and second data are contemporaneous, and thus code for doing so. In this regard, in an exemplary embodiment, method 1100 and/or method 1200 is executed by a system according to any of the teachings detailed herein, and can include the central processor apparatus detailed above. The central processor apparatus can be receiving input from various locations at the same time and/or temporally spaced apart. The system can have utilitarian value with respect to determining whether or not the input is contemporaneous with each other and/or whether it is not contemporaneous with each other. Such can have utilitarian value with respect to discounting or otherwise disregarding certain data and/or prioritizing certain data over other data.

Also, another aspect of central/edge processing which can be utilized in some embodiments that utilize such processing is that at any point the speech/voice data can be parametrized or otherwise modified in such a way that the utilitarian characteristics could still be determined without the actual speech information being transmitted or stored. This could be executed to achieve basic privacy and/or security measures. Indeed, proxies can be utilized that are representative of the data. Encryption and codes can be utilized. Such can be implemented where the embodiments utilize computer-based systems and/or machine learning systems. In fact, the data can be such that no one could ever evaluate the data for the underlying content thereof. In some embodiments, there are mechanisms such as, for example, federated learning where AI models are locally trained and parameters globally shared to protect privacy while allowing the overall system to improve not only based on what is happening in the single household but households (or any other unitized entity/structure) statewide or nationwide or worldwide.

Further, in an exemplary embodiment, there is the method of determining whether or not data is relevant to executing the identification of a hearing impacting influencing feature. In this regard, again, such as in a scenario where there are multiple microphones located throughout the building, data can be received by the central processing apparatus, where the data is based on data collected at different spatial locations around the building. In an exemplary embodiment, the system is configured to automatically analyze the data that is received and determine whether or not such as relevant to implementing the teachings detailed herein. By way of example only and not by way of limitation, the system can be configured or otherwise programmed to perform spectral analysis on voices that are captured by the various microphones, to determine whether or not a given voice is relevant. Such can be combined with other data that is inputted into the system, such as the location of various parties relative to one another. For example, with respect to the embodiment where the father is reading to the child, data based on the mother's voice who is in another room could be discounted or otherwise disregarded upon a determination that that is not relevant to implementing the teachings detailed herein. For example, if the microphone in the room where the father and the recipient's child is located is not picking up the sound of the mother's voice, a determination can be made that the mother's voice is not impacting the events associated with the child's ability to perceive what the father is saying. Conversely, if the microphone in the room with the father and the recipient child is located is indeed picking up the sound of the mother's voice, a determination can be made that this is relevant to executing identification of a hearing impacting influencing feature. It is noted that the relevance and the contemporaneous features can be utilized simultaneously to determine how to disposition data. By way of example only and not by way of limitation, even if the mother's voice was being picked up by the microphone in the room where the father and the child is located, if the mother's voice is temporally interleaved in a manner that does not impact the ability of the child recipient to understand the father or otherwise perceive with the father saying, that data associated with the mother's voice might be discounted.

Accordingly, in an exemplary embodiment, there can be a medium that includes code for determining whether first data and second data and/or first data and/or other data and/or second data and other data are contemporaneous and/or relevant to executing the identification of a hearing impacting influencing feature.

Consistent with the teachings detailed above, in an exemplary embodiment, such as where some of the method actions detailed herein are executed utilizing a computer program, in an exemplary embodiment, the computer program is part of a household Internet of things and/or a building Internet of things. Still further, in an exemplary embodiment, any of the mediums associated with any of the actions detailed herein can be stored in a system that receives input from various data collection devices arrayed in a building, which data collection devices are dual-use devices with respect to utilization beyond identifying a hearing impacting influencing feature.

In view of the above, it can be seen that in some embodiments, the teachings detailed herein can be utilized to identify and/or modify an environment in which a recipient of a hearing prosthesis exists. In some embodiments, the teachings detailed herein can be configured to identify environmental strategies and/or ways to manipulate an environment that can be utilitarian with respect to a recipient's habilitation and/or rehabilitation or otherwise with respect to the recipient having an improved experience utilizing the prosthesis relative to that which would otherwise be the case. Of course, consistent with the teachings above, in some embodiments the system is configured to actually manipulate the environment.

Some embodiments are directed towards a self-contained system that is implemented entirely within a household or within the building. That said, in some other embodiments, the teachings detailed herein are used in part with a processing center that is remote from the house or the like. By way of example only and not by way of limitation, in an exemplary embodiment, the data that is collected utilizing the components of the system can be provided and/or data that is based on such data can be provided to a remote processing center, where such is analyzed, and then the remote processing center remotely control components in the house and/or can provide the recommendations. Accordingly, embodiments include utilizing a centralized processing center to process the data and thus implement at least some of the teachings detailed herein.

Further, while many embodiments focus on systems that execute some or more or all of the method actions detailed herein in an automated fashion, some other embodiments utilize a trained professional such as an audiologist or the like to evaluate data. In this regard, the teachings detailed herein can be utilized for long-term or detailed data collection purposes without automated or mechanized evaluation. The data that is collected can be manually evaluated, and the recommendations can be based on the expertise of the people associated with the evaluation.

Some embodiments disclosed above provided scenarios where the feature of the hearing prostheses was adjusted based on the data collected from non-hearing prosthesis components. In an exemplary embodiment, the adjustment can occur in real time. In an exemplary embodiment, any of the microphone features of the hearing prosthesis can be adjusted providing that such is utilitarian value based on the analysis of the data obtained by the various microphones, whether or not such data includes data associated with the microphone of the hearing prosthesis. Frequency selection can be implemented based on the evaluations, so that the hearing prosthesis will apply different gains to different frequencies based on the analysis. In an exemplary embodiment, there is utilitarian value in such because the other microphone might have a "cleaner" target signal and can therefore more accurately be the basis for suggestion of adjustments that can be utilitarian so as to coherently extract the useful components/signal from the noise. There is an embodiment here where the other microphone can continuously transmit a coherence envelope that can be used by the processor or otherwise the system for improved noise cancellation. This is an exemplary embodiment of an example of how the two systems/components of a given system might interact in a semi-continuous way.

It is also noted that in at least some exemplary embodiments, the various microphones of the components can be utilized as sound capture devices for the hearing prosthesis. In an exemplary embodiment, any of these microphones can function as the so-called remote mic for the hearing prosthesis. In an exemplary embodiment, audio signals based on sound captured by the various microphones are streamed in real time to the prosthesis, and utilized as the input into the sound processor, and a hearing percept is evoked based on the stream data. Moreover, in an exemplary embodiment, the features of the sound processor, indeed, the functionality of the sound processor itself, is present in one or more of the components of the system. In an exemplary embodiment, the sound processing is executed at a component remote from the prosthesis. A signal based on the processor sound is then streamed in real time to the prosthesis, which utilizes that stream signal to directly evoke a hearing percept based thereon.

An in between scenario can include the system executing some of the processing of the hearing prosthesis that is not related to pure sound processing to evoke a hearing percept. For example, the prosthesis can include a scene classification system and/or a noise cancellation determination system and/or a beamforming control system, etc., all of which would utilize processing power of the hearing prosthesis. In some exemplary embodiments, this could tax the computing capabilities of the hearing prosthesis, and thus might impact the sound processing functions. Accordingly, in an exemplary embodiment, some of the processing is offloaded or otherwise executed by a portion of the system that is separate from the hearing prosthesis, and then this data is provided to the hearing prosthesis and thus is utilized to control the hearing prosthesis.

It is further noted that while the teachings detailed herein have focused on hearing aids and implantable prostheses, some other embodiments include utilization of a personal sound amplification device that is not a hearing aid per se in the traditional sense. These teachings can also be applicable to such.

Also consistent with the teachings detailed above, in an exemplary embodiment, method 1100 further includes the action of providing data to a human pertaining to the identified hearing impacting influencing feature via a common household component (e.g., television, speaker, email, etc.) and/or there is the action of automatically controlling a component in a building in which the sound is captured based on the identified hearing impacting influence.

Referring back to the exemplary scenarios where the father is being instructed on how to conduct himself around his son or daughter, the hearing impacting influencing feature is a behavioral aspect of a person other than the recipient.

It was briefly noted above that features associated with the hearing prostheses can be utilized to implement the teachings detailed herein. In an exemplary embodiment, the system's devices and methods disclosed herein and variations thereof can also utilize own voice detections to further the implementations of the teachings. It is briefly noted that while the own voice detection systems are often implemented in the hearing prosthesis, in some other embodiments, the system itself can utilize voice detection algorithms or the like, and can utilize the algorithms and variations thereof that are utilized by the hearing prostheses to identify own voice to identify the voice of the recipient, as the recipient in many cases is the focus of the utilitarian value according to at least some of the teachings detailed herein. Accordingly, exemplary embodiments include non-prosthesis components that also include own voice to text and, which detection is directed towards detecting the voice of the recipient as compared to other parties.

In an exemplary embodiment, own voice detection is executed according to any one or more of the teachings of U.S. Patent No. 2016/0080878 and/or the implementation of the teachings associated with the detection of the invoice herein are executed in a manner that triggers the control techniques of that application. Accordingly, in at least some exemplary embodiments, the prosthesis 100 and/or the device 240 and/or an in the other components of the systems detailed herein can be configured to or otherwise include structure to execute one or more or all of the actions detailed in that patent application. Moreover, embodiments include executing methods that correspond to the execution of one or more the method actions detailed in that patent application.

In an exemplary embodiment, own voice detection is executed according to any one or more of the teachings of WO 2015/132692 and/or the implementation of the teachings associated with the detection of own voice herein are executed in a manner that triggers the control techniques of that application. Accordingly, in at least some exemplary embodiments, the prosthesis 100 and/or the device 240 and/or one of the other components of the systems detailed herein are configured to or otherwise include structure to execute one or more or all of the actions detailed in that patent application. Moreover, embodiments include executing methods that correspond to the execution of one or more the method actions detailed in that patent application.

In an exemplary embodiment of method 1100, the method actions are executed as part of a hearing habilitation and/or rehabilitation program and/or a real time hearing perception improvement program. In an exemplary embodiment, such as where method actions of method 1100 are codified in a computer readable medium, the computer program can be a dual-purpose hearing habilitation and/or rehabilitation program and a real time hearing perception improvement program. In this regard, referring to the exemplary scenario where a person is having a dinner conversation with some friends, a system implementing computer code associated with method 1100 can provide recommendations to reduce the music that is playing or even control the music itself, thus achieving real time hearing perception improvements, and can also later or at the same time for that matter provide data indicative of how the recipient should move people around people are not located when his or her non-implanted side, or the utilitarian value associated with a bilateral implant, thus providing habilitation and/or rehabilitation data.

The habilitation and/or rehabilitation features according to the teachings detailed herein can have utilitarian value with respect to improving a recipient's ability to utilize or otherwise achieve utilitarian value with respect to his or her hearing prostheses over the long term. Also, the habilitation and/or rehabilitation features according the teachings detailed herein can provide data indicative of how well or how not well a recipient is progressing.

Some embodiments link rehabilitation tools and/or content such that the embodiments can provide tailored recommendations for self-training and prescribed intervention based on the data collected through one or more actions, and, in some embodiments, in addition to allowing the recipient, parent, or professional to track and monitor progress trajectories. In an exemplary embodiment, these actions can be based at least in part on the data collected by any of the components associated with the teachings detailed herein. Some embodiments include a library of rehabilitation resources & tools, and can include extensive portfolio of resources to support recipients and the professionals working with them across all ages and stages. In an exemplary embodiment, the action of identifying actions that can be taken to improve perception can include evaluating these rehabilitation resources and/or tools and providing recommendations to the recipient or to a caregiver, etc.

To be clear, in some embodiments, any of the teachings detailed herein can be directed to solely a rehabilitation/habilitation system (while other embodiments are specifically excluded from being a rehabilitation/habilitation system). An embodiment of a system that has habilitation/rehabilitation features includes the utilization of such to influence recipient/caregiver behavior such that they engage in activities that support improved outcomes over time, such influence or at least recommendations for influence occurring automatically. An exemplary embodiment includes the system constantly or periodically monitoring interactions of people with the recipient and vice versa and evaluates how far the recipient of the other parties associated with recipient are progressing along a rehabilitation/habilitation path, again based on data obtained according to the teachings detailed herein, in at least some exemplary embodiments, the system can provide an indication as to recommendations for habilitation and/or rehabilitation.

It is noted that in at least some instances herein, the word "habilitation" or the word "rehabilitation" is utilized instead of the phrase "habilitation and/or rehabilitation." Any disclosure herein of one corresponds to a disclosure of both unless otherwise noted.

Some embodiments include utilizing the data obtained by the non-hearing prostheses components for analysis and prediction and/or recommendation associated with habilitation and/or rehabilitation. Here, the system can be implemented to use the set of input data to determine such things as, for example, which cohort does the user belong to, where does the user sit in comparison to the rest of the cohort and is the answer a reasonable answer. The system can also predict where the recipient performance statistics are going to be according to the status quo and/or predict potential performance benefits from different interventions or rehabilitation activities. Utilizing the data obtained according to the teachings detailed herein, predictions or evaluations associated with a habilitation and/or rehabilitation can be established.

Some embodiments include a recommendation engine to generate recommendations. The recommendation engine can use a set of input data and the predictions. The result can be, from the relative performance vs. the user's cohort and the predictions, determine if intervention is required, ranking of rehabilitation activities, such as, for example, by the potential performance benefits.

By way of example only and not by way of limitation, the system can be configured to evaluate the data obtained from the various components detailed herein to make a determination as to where the recipient engages in a limited number of conversations and/or engages in conversation that are only brief, which can indicate that the recipient is not habilitating and/or rehabilitating by an amount that otherwise should be the case for that recipients given cohort. In an exemplary embodiment, there is the analysis and/or measurement of speech production deviance in terms of intelligibility ratings, which can be monitored, and can be used as an indicator as to whether or not the recipient is progressing in the habilitation and/or rehabilitation journey. All of this can be analyzed to determine or otherwise gauge a level of habilitation and/or rehabilitation, and to identify actions that can be utilitarian with respect to improving habilitation and/or rehabilitation.

Moreover, what is being said by the recipient and/or to the recipient can be an indicator as to whether or not the recipient is progressing in the habilitation and/or rehabilitation journey. In this regard, if the recipient frequently uses small words and limited vocabulary when speaking, even to adults or the like, this can be an indicator that the recipient's habilitation and/or rehabilitation has been stunted or otherwise is not progressing along the lines that otherwise could be. The data that is utilized to determine how the recipient is speaking can be obtained via the components detailed herein. Moreover, if the recipient speaks slowly and/or if the people that talk to the recipient speak slowly, that too can be an indicator that the recipient's habilitation and/or rehabilitation has been stunted or otherwise is not progressing along the lines that otherwise could be the case. Again, the data can be obtained utilizing the components disclosed herein. Pronunciation as well can be an indicator. If words are being pronounced in a manner that would be analogous to someone having a diagnosis of a speech impediment, with a recipient does not have one, such can be an indicator of lacking progress. Thus, according to an exemplary embodiment, there is a method of any system for capturing data indicative of any of the aforementioned indicators, analyzing that data, and making a determination regarding a habilitation and/or rehabilitation of a recipient and/or what might be utilitarian with respect to improving habilitation and/or rehabilitation.

In this regard, some exemplary methods include analyzing a captured voice and analyzing non-voice data and/or other data that the system can obtain to identify at least one of (i) a weakness in an impaired hearing person's habilitation and/or rehabilitation regime or (ii) a real-world scenario identified by using the voice sound and/or the data and/or the functional listening behavior data as latent variables. With respect to the former, the identification of a weakness in an impaired hearing person's habilitation and/or rehabilitation regime, in an exemplary embodiment includes determining whether or not to intervene in the regime. Accordingly, some exemplary methods include a determination as to whether or not an intervention is utilitarian. Accordingly, in an exemplary embodiment, at least some of the teachings detailed herein can be utilized to detect or otherwise determine that there is a problem with a habilitation and/or a rehabilitation regime, and also can determine that there is no habilitation and/or rehabilitation regime.

As seen from the above, embodiments include analyzing the captured voice and the data obtained by the methods herein to identify a habilitation and/or rehabilitation action that should be executed or should no longer be executed. Accordingly, at least some exemplary embodiments include analyzing any of the data obtained according to any of the teachings detailed herein to identify a habilitation and/or rehabilitation action that should be executed or should no longer be executed.

In an exemplary embodiment associated with the action of determining a hearing habilitation and/or rehabilitation related feature, such can correspond to any of the actions detailed herein associated with habilitation and/or rehabilitation of hearing. By way of example only and not by way of limitation, the increasing time in a voice sound environment, and/or the utilization of music to reconnect through focused practice can be a habilitation and/or rehabilitation related feature. Still further by way of example only and not by way of limitation, the habilitation and/or rehabilitation feature can be a feature that is deleterious to the ultimate goal of such, such as by way of example only and not by way of limitation, a determination that the recipient frequently does not use the hearing prostheses, which might be able to be extracted from the data obtained by the various components.

An exemplary embodiment includes utilizing any of the teachings detailed in U.S. provisional patent application Ser. No. 62/703,373, entitled habilitation and/or rehabilitation methods and systems, filed on Jul. 25, 2018, in the United States Patent and Trademark Office, listing Jeanette Oliver as an inventor, where the data obtained to execute those teachings is obtained in accordance with the teachings detailed herein and/or where the system according to the teachings detailed herein and/or the methods associated there with our configured to slash result in the execution of habilitation and/or rehabilitation regime's according to the teachings of the aforementioned patent application.

It is briefly noted that in at least some exemplary embodiments, concentration on voice and conversation and interaction between two parties is the focus of the teachings detailed herein. In some embodiments, there need not necessarily be conversation taking place. Concomitant with the teachings detailed above associated with the music and/or listening patterns of the recipient, in an exemplary embodiment, the components of the systems detailed herein can be utilized to collect data unrelated to conversation. In an exemplary embodiment, the data that is collected corresponds to the recipient's music listening preferences/patterns, the recipient's television listening or radio listening preferences/patterns, the amount of time that the recipient utilizes the hearing prosthesis in a high background noise environment, etc. Thus, embodiments include obtaining data that is not associated with conversation and analyzing the data to develop recommendations regarding habilitation and/or rehabilitation, and/or to develop recommendations that can improve the ability of the recipient to hear or otherwise perceive sound on a real-time basis.

It is briefly noted that in at least some exemplary embodiments of the teachings detailed herein, the systems can rely on people identification and/or people placement data to augment or supplement data that is obtained by the system. In this regard, in an exemplary embodiment, while some of the teachings detailed herein have focused on the utilization of voice identification to determine or otherwise identify the placement of people in a given building and/or relative to a recipient, in some alternate embodiments, other techniques can be utilized, such as, for example, RFID tracking devices that can provide input to the system that can enable the system to determine the spatial location of people and/or components on a temporally pertinent basis. Alternatively, and/or in addition to this, visual methods, such as the utilization of video camera or the like, can be utilized to identify the location of people and/or components, etc. All of this can be done in real-time or quasi-real time so as to provide better details associated with the data that is obtained vis-à-vis implementing the teachings herein.

It is also noted that in at least some exemplary embodiments, sophisticated programs can be utilized to take into account the structure of a building or the like. By way of example only and not by way of limitation, a program can include features associated with the layout of a house and/or the acoustics associated with a house, which acoustics and/or layouts can be utilized to better analyze the data provided by the various components of the device so as to determine whether or not certain actions to be taken. By way of example only and not by way of limitation, in a scenario where person A is in a basement and the hearing prosthesis recipient is on the second or third floor of a house, and person A is trying to get the recipient's attention, person A is not shouting loud enough, the system might affirmatively determine that no intervention will be made, because the normal hearing person would likely not be able to hear Person A. Still further by way of example, the system can be configured to evaluate the spatial data associated with the father talking on the phone, and if a determination is made that the father is sufficiently far enough away from the child and the mother, even though the system determines a problem with the interaction between the child and the mother, the system might discount the fact that the father is speaking on the phone because of the spatial locations associated therewith.

The point is that the system can be configured to obtain and/or utilize data beyond mere data resulting from sound captured by various microphones located around the house or other building.

Indeed, in perhaps an extreme example, the system can be configured to obtain data indicative of and determine based thereon whether or not the recipient has on his or her hearing prostheses. If the system determines that the hearing prosthesis is not being used, the system could be configured to not implement any actions according to the teachings detailed herein, other than, perhaps, indicate by way of any of the communication scenarios detailed herein, that the recipient should start wearing his or her hearing prostheses. Thus, in an exemplary embodiment, the teachings detailed herein are not alarm systems of the like or otherwise devices that augment the recipient's ability to hear or to notify the recipient that he or she should be hearing something that he or she is not hearing. Another way, exemplary embodiments according to some embodiments are not crutches for recipient, but instead, again, are habilitation and/or rehabilitation tools, and otherwise improve the overall usage experience of the hearing prosthesis It is briefly noted that in an exemplary embodiment, cochlear implant 100 and/or the device 240 and/or any other components detailed herein are utilized to capture speech/voice of the recipient and/or people speaking to the recipient. It is briefly noted that any disclosure herein of voice (e.g., capturing voice, analyzing voice, etc.) corresponds to a disclosure of an alternate embodiment of using speech (e.g., capturing speech, analyzing speech, etc.), and vice versa, unless otherwise specified, providing that the art enables such. This is not to say that the two are synonymous. This is to say that in the interests of textual economy, we are presenting multiple disclosure based on the use of one. It is also noted that in at least some instances herein, the phrase voice sound is used. This corresponds to the sound of one's voice, and can also be referred to as "voice."

It is noted that in at least some exemplary embodiments, the sound scene classification is executed in accordance with the teachings of US patent application publication number 2017/0359659. Accordingly, in at least some exemplary embodiments, the prosthesis 100 and/or the device 240 and/or other components of the system are configured to or otherwise include structure to execute one or more or all of the actions detailed in that patent application. Moreover, embodiments include executing methods that correspond to the execution of one or more the method actions detailed in that patent application.

In an exemplary embodiment, the action of capturing voice is executed during a normal conversation outside of a testing environment. Indeed, in an exemplary embodiment, this is the case for all of the methods detailed herein. The teachings detailed herein can have utilitarian value with respect to obtaining data associated with a hearing-impaired person as the hearing-impaired person travels through normal life experiences. Such can be utilitarian with respect to the fact that much more data can be obtained relative to that which be the case in limited testing environments. Further, more dynamic data can be obtained/the data can be obtained more frequently relative to that which would be the case if the data was limited to only testing environments.

In this regard, in at least some exemplary embodiments include capturing voice and/or sound during times of social communication engagement. In this regard, at least some exemplary embodiments include capturing sound only during such engagements. Corollary to this is that in at least some exemplary embodiments include capturing sound during hearing mediated social communication scenarios.

In an exemplary embodiment, at least 50, 55, 60, 65, 70, 75, 80, 85, 90, 91, 92, 93, 94, 95, 96, 97, 98, 99, or 100% of the voice that is captured and/or utilized according to the teachings detailed herein is voice that is captured during a normal conversation outside of a testing environment and/or is voice associated with hearing mediated social communication. Note that a normal conversation can include the voice interaction between an infant and an adult, and thus the concept of a conversation is a very broad concept in this regard. That said, in some other embodiments, the normal conversation is a sophisticated conversation which is limited to a conversation between fully mentally developed people.

In an exemplary embodiment, the methods detailed herein can also include determining an intervention regime after a determination is made that there is a need for intervention.

Consistent with the teachings detailed herein, where any one or more of the method actions detailed herein can be executed in an automated fashion unless otherwise specified, in an exemplary embodiment, the action of determining an intervention regime can be executed automatically.

It is noted that any method detailed herein also corresponds to a disclosure of a device and/or system configured to execute one or more or all of the method actions associated there with detailed herein. In an exemplary embodiment, this device and/or system is configured to execute one or more or all of the method actions in an automated fashion. That said, in an alternate embodiment, the device and/or system is configured to execute one or more or all of the method actions after being prompted by a human being. It is further noted that any disclosure of a device and/or system detailed herein corresponds to a method of making and/or using that the device and/or system, including a method of using that device according to the functionality detailed herein.

Any action disclosed herein that is executed by the prosthesis 100 can be executed by the device 240 and/or another component of any system detailed herein in an alternative embodiment, unless otherwise noted or unless the art does not enable such. Thus, any functionality of the prosthesis 100 can be present in the device 240 and/or another component of any system in an alternative embodiment. Thus, any disclosure of a functionality of the prosthesis 100 corresponds to structure of the device 240 and/or the another component of any system detailed herein that is configured to execute that functionality or otherwise have a functionality or otherwise to execute that method action.

Any action disclosed herein that is executed by the device 240 can be executed by the prosthesis 100 and/or another component of any system disclosed herein in an alternative embodiment, unless otherwise noted or unless the art does not enable such. Thus, any functionality of the device 240 can be present in the prosthesis 100 and/or another component of any system disclosed herein in an alternative embodiment. Thus, any disclosure of a functionality of the device 240 corresponds to structure of the prosthesis 100 and/or another component of any system disclosed herein that is configured to execute that functionality or otherwise have a functionality or otherwise to execute that method action.

Any action disclosed herein that is executed by a component of any system disclosed herein can be executed by the device 240 and/or the prosthesis 100 in an alternative embodiment, unless otherwise noted or unless the art does not enable such. Thus, any functionality of a component of the systems detailed herein can be present in the device 240 and/or the prosthesis 100 as alternative embodiment. Thus, any disclosure of a functionality of a component herein corresponds to structure of the device 240 and/or the prosthesis 100 that is configured to execute that functionality or otherwise have a functionality or otherwise to execute that method action.

It is further noted that any disclosure of a device and/or system detailed herein also corresponds to a disclosure of otherwise providing that device and/or system.

It is also noted that any disclosure herein of any process of manufacturing other providing a device corresponds to a device and/or system that results therefrom. Is also noted that any disclosure herein of any device and/or system corresponds to a disclosure of a method of producing or otherwise providing or otherwise making such.

Any embodiment or any feature disclosed herein can be combined with any one or more or other embodiments and/or other features disclosed herein, unless explicitly indicated and/or unless the art does not enable such. Any embodiment or any feature disclosed herein can be explicitly excluded from use with any one or more other embodiments and/or other features disclosed herein, unless explicitly indicated that such is combined and/or unless the art does not enable such exclusion.

While various embodiments of the present invention have been described above, it should be understood that they have been presented by way of example only, and not limitation. It will be apparent to persons skilled in the relevant art that various changes in form and detail can be made therein without departing from the spirit and scope of the invention.

What is claimed is:

1. A system, comprising:

a first microphone of a non-body carried device; and a processor configured to receive input based on sound captured by the first microphone and analyze the received input to:

determine whether the sound captured by the first microphone is indicative of an attempted communication to a human, which human is located in a structure where the microphone is located; and upon a determination that the sound is indicative of an attempted communication to a human, evaluate the success and/or probability of success of that communication.

2. The system of claim 1, wherein:

the first microphone is part of a smart device.

3. The system of claim 1, further comprising:

a second microphone, wherein the second microphone is a microphone of a hearing assistance device.

4. The system of claim 1, wherein:

the first microphone is one of a plurality of microphones of non-prosthesis devices located at different spatial locations in a structure, which microphones are in signal communication with the processor.

5. The system of claim 1, wherein:

the system is configured to, in real time relative to the capturing of the sound, determine whether the sound is indicative of an attempted communication between humans, and determine evaluate the success of that communication.

6. The system of claim 1, wherein:

the system is further configured to, based on the evaluation of the success of the communication, provide recommendations to improve a likelihood that future communications will be more successful, all things being equal.

7. The system of claim 1, wherein:

the sound captured by the first microphone indicative of an attempted communication to a human is a sound captured by the first microphone that is indicative of an attempted communication between humans, which humans are located in the structure where the microphone is located; and the processor is configured to, upon a determination that the sound is indicative of an attempted communication between humans, evaluate the success and/or probability of success of that communication.

8. A system, comprising:

a first microphone of a non-hearing prosthesis device; and a processor configured to receive input based on data captured by the first microphone and analyze the received input in real time to identify a change to improve perception by a recipient of a hearing prosthesis, which change can include changes unrelated to the first microphone.

9. The system of claim 8, wherein:

the change is a change in an action of a party associated with the speech to improve speech perception by a recipient of a hearing prosthesis.

10. The system of claim 8, wherein:

the change is a change to a device that is part of the system to improve speech perception by a recipient of a hearing prosthesis.

11. The system of claim 8, wherein:

the system is configured to provide an indication to the recipient and/or to others associated with the recipient of the change.

12. The system of claim 8, wherein:

the system is configured to receive second input based on data that is not based on sound captured by a microphone, which data is indicative of an operation of a device within a structure in which the recipient is located, and, analyze the received second input along with the received input in real time to identify a change to improve perception by a recipient of a hearing prosthesis.

13. The system of claim 8, wherein:

the change is a change to a device in an apparatus that is unrelated to a hearing prosthesis and unrelated to sound capture to obtain data upon which a hearing percept evocation by the hearing prosthesis is based.

14. The system of claim 8, wherein:

the change is a change to an environment of the device.

15. A non-transitory computer readable medium having recorded thereon, a computer program for executing at least a portion of a method, the computer program including:

code for analyzing first data based on data captured by non-hearing prosthesis components; and code for identifying a hearing impacting influencing feature unrelated to a microphone based on the analysis of the first data.

16. The medium of claim 15, further comprising:

code for analyzing second data based on data indicative of a recipient of a hearing prosthesis's reaction to ambient sound exposed to the recipient contemporaneously to the data captured by the non-hearing prosthesis components, wherein the code for identifying a hearing impacting influencing feature based on the analysis of the first data includes code for identifying the hearing impacting influencing feature based on the analysis of the first data in combination with the analysis of the second data.

17. The medium of claim 15, wherein:

the hearing impacting influencing feature is a behavioral aspect of a person other than the recipient.

18. The medium of claim 15, wherein:

the medium is stored in a system that receives input from various data collection devices arrayed in a building, which data collection devices are dual-use devices with respect to utilization beyond identifying a hearing impacting influencing feature.

19. The medium of claim 15, further comprising:

code for providing data to a human pertaining to the identified hearing impacting influencing feature via a common household component.

20. The medium of claim 15, further comprising:

code for automatically controlling a component in a building in which the sound is captured based on the identified hearing impacting influence.

21. The medium of claim 15, further comprising:

code for identifying a hearing impacting influencing feature related to a microphone based on the analysis of the first data.

22. The system of claim 1, wherein:

the processor is further configured to analyze the received input to, upon a determination that the sound is indicative of an attempted communication to a human, evaluate the effortfulness of the human to understand the communication.

* * * * *